US008910968B2

(12) United States Patent
Pelchat

(10) Patent No.: US 8,910,968 B2
(45) Date of Patent: Dec. 16, 2014

(54) BINDING SYSTEM FOR RECREATIONAL BOARD

(75) Inventor: Jean-Francois Pelchat, Whistler (CA)

(73) Assignee: JF Pelchat Inc., Whistler (CA)

( * ) Notice: Subject to any disclaimer, the term of this patent is extended or adjusted under 35 U.S.C. 154(b) by 30 days.

(21) Appl. No.: 13/318,103

(22) PCT Filed: Apr. 30, 2010

(86) PCT No.: PCT/CA2010/000648

§ 371 (c)(1),
(2), (4) Date: Oct. 28, 2011

(87) PCT Pub. No.: WO2010/124382

PCT Pub. Date: Nov. 4, 2010

(65) Prior Publication Data

US 2012/0056392 A1 Mar. 8, 2012

Related U.S. Application Data

(60) Provisional application No. 61/174,361, filed on Apr. 30, 2009.

(51) Int. Cl.

| | |
|---|---|
| ***A63C 10/26*** | (2012.01) |
| ***A63C 10/00*** | (2012.01) |
| ***A63C 10/04*** | (2012.01) |
| *A63C 10/24* | (2012.01) |
| *A63C 10/18* | (2012.01) |
| *A63C 10/20* | (2012.01) |

(52) U.S. Cl.

CPC ..... *A63C 10/04* (2013.01); *A63C 10/24* (2013.01); *A63C 10/005* (2013.01); *A63C 10/18* (2013.01); *A63C 10/20* (2013.01)

USPC ..... 280/618; 280/14.22; 280/14.24

(58) Field of Classification Search

USPC ..... 280/617, 618, 623, 624, 625, 631, 633, 280/14.21, 14.22, 14.24

See application file for complete search history.

(56) References Cited

U.S. PATENT DOCUMENTS

| | | | | |
|---|---|---|---|---|
| 2,593,974 | A | 4/1952 | Brown | |
| 2,740,972 | A | 4/1956 | Taylor | |
| 2,933,741 | A | 4/1960 | Walter | |
| 3,102,279 | A | 9/1963 | Bennett | |
| 3,127,623 | A | 4/1964 | Roudebush | |
| 3,260,531 | A * | 7/1966 | Heuvel | 280/602 |

(Continued)

FOREIGN PATENT DOCUMENTS

| | | |
|---|---|---|
| CA | 2247950 | 9/1997 |
| CH | 678278 | 8/1991 |

(Continued)

*Primary Examiner* — Frank Vanaman

(74) *Attorney, Agent, or Firm* — Oyen Wiggs Green & Mutala LLP

(57) ABSTRACT

Binding systems for recreational boards are provided. A binding system is mounted atop a rider-support surface of the board. Portions of the binding system are pivotal with the rider's foot and with respect to the board. This pivotal motion may allow the rider to have greater control over the application of weight to the heel and/or toe edges of the board. In particular embodiments, the binding system comprises: a base rigidly mounted atop rider-support surface of the board; and a foot-retainer pivotally mounted to the base via pivot couplings for pivotal motion of the foot-retainer relative to the base and the board.

51 Claims, 11 Drawing Sheets

(56) References Cited

U.S. PATENT DOCUMENTS

| | | | | |
|---|---|---|---|---|
| 4,728,116 | A | 3/1988 | Hill | |
| 4,871,337 | A | 10/1989 | Harris | |
| 4,896,895 | A * | 1/1990 | Bettosini | 280/607 |
| 5,021,017 | A | 6/1991 | Ott | |
| 5,028,068 | A | 7/1991 | Donovan | |
| 5,044,656 | A | 9/1991 | Peyre | |
| 5,125,680 | A * | 6/1992 | Bejean et al. | 280/615 |
| 5,261,689 | A | 11/1993 | Carpenter et al. | |
| 5,277,635 | A | 1/1994 | Gillis | |
| 5,354,088 | A | 10/1994 | Vetter et al. | |
| 5,356,170 | A | 10/1994 | Carpenter et al. | |
| 5,433,636 | A | 7/1995 | Gillis | |
| 5,499,837 | A | 3/1996 | Hale et al. | |
| 5,553,883 | A | 9/1996 | Erb | |
| 5,558,355 | A | 9/1996 | Henry | |
| 5,577,755 | A | 11/1996 | Metzger et al. | |
| 5,584,492 | A | 12/1996 | Fardie | |
| 5,586,779 | A | 12/1996 | Dawes et al. | |
| 5,660,410 | A | 8/1997 | Alden | |
| 5,667,237 | A | 9/1997 | Lauer | |
| 5,758,895 | A * | 6/1998 | Bumgarner | 280/607 |
| 5,826,910 | A | 10/1998 | Ricks et al. | |
| 5,899,483 | A | 5/1999 | Paris | |
| 5,901,975 | A * | 5/1999 | Phipps | 280/618 |
| 5,909,893 | A | 6/1999 | Keller et al. | |
| 5,915,718 | A | 6/1999 | Dodge | |
| 5,947,488 | A | 9/1999 | Gorza et al. | |
| 5,947,508 | A | 9/1999 | Graf et al. | |
| 5,967,531 | A | 10/1999 | Saillet | |
| 5,967,542 | A | 10/1999 | Williams et al. | |
| 5,975,557 | A | 11/1999 | Snoke et al. | |
| 5,984,346 | A | 11/1999 | Keller | |
| 6,015,161 | A | 1/2000 | Carlson | |
| 6,062,584 | A | 5/2000 | Sabol | |
| 6,082,026 | A | 7/2000 | Sand et al. | |
| 6,089,581 | A | 7/2000 | Partridge | |
| 6,099,018 | A | 8/2000 | Maravetz et al. | |
| 6,155,578 | A | 12/2000 | Patterson | |
| 6,189,899 | B1 | 2/2001 | Carlson | |
| 6,189,911 | B1 | 2/2001 | Caron et al. | |
| 6,203,051 | B1 | 3/2001 | Sabol | |
| 6,302,428 | B1 | 10/2001 | Jungkind | |
| 6,336,650 | B1 | 1/2002 | Alspaugh | |
| 6,382,641 | B2 | 5/2002 | Dennis et al. | |
| 6,390,492 | B1 | 5/2002 | Bumgarner et al. | |
| 6,428,032 | B1 | 8/2002 | Humbel | |
| 6,457,736 | B1 | 10/2002 | Maravetz et al. | |
| 6,485,035 | B1 | 11/2002 | Laughlin et al. | |
| 6,491,310 | B1 | 12/2002 | Work | |
| 6,523,851 | B1 | 2/2003 | Maravetz | |
| 6,581,944 | B1 | 6/2003 | Marmonier et al. | |
| 6,631,919 | B1 | 10/2003 | West et al. | |
| 6,736,413 | B2 | 5/2004 | Laughlin et al. | |
| 6,789,806 | B2 | 9/2004 | Santa Cruz et al. | |
| 6,945,544 | B2 | 9/2005 | Feurer et al. | |
| 7,063,346 | B2 | 6/2006 | Elkington | |
| 7,077,403 | B2 | 7/2006 | Laughlin et al. | |
| 7,097,195 | B2 * | 8/2006 | Orr et al. | 280/628 |
| 7,204,495 | B2 | 4/2007 | Reuss et al. | |
| 7,566,062 | B2 | 7/2009 | Reuss et al. | |
| 7,748,729 | B2 | 7/2010 | Laughlin et al. | |
| 7,992,888 | B2 | 8/2011 | Steere | |
| 2001/0038182 | A1 | 11/2001 | Carlson | |
| 2002/0185840 | A1 | 12/2002 | Schaller et al. | |
| 2002/0185841 | A1 | 12/2002 | Schaller et al. | |
| 2003/0011171 | A1 | 1/2003 | Battistella | |
| 2003/0042709 | A1 | 3/2003 | Dodge | |
| 2003/0116931 | A1 | 6/2003 | Quatrro et al. | |
| 2003/0178812 | A1 | 9/2003 | Schaller et al. | |
| 2003/0189316 | A1 | 10/2003 | Schaller et al. | |
| 2003/0209881 | A1 | 11/2003 | Krumbeck et al. | |
| 2003/0230870 | A1 | 12/2003 | Sabol | |
| 2004/0017064 | A1 | 1/2004 | Brown et al. | |
| 2004/0150194 | A1 * | 8/2004 | Okajima | 280/625 |
| 2005/0167933 | A1 | 8/2005 | Couderc | |
| 2005/0248129 | A1 | 11/2005 | Pelchat | |
| 2010/0295269 | A1 | 11/2010 | Krenn et al. | |

FOREIGN PATENT DOCUMENTS

| | | |
|---|---|---|
| EP | 0351298 | 1/1990 |
| EP | 0612546 | 8/1994 |
| EP | 1741474 | 1/2007 |
| FR | 2715861 | 8/1995 |
| WO | 9703733 | 2/1997 |
| WO | 02053240 | 7/2002 |
| WO | 02076561 | 10/2002 |

* cited by examiner

BINDING SYSTEM FOR RECREATIONAL BOARD

RELATED APPLICATIONS

This application claims priority from U.S. application No. 61/174,361 filed 30 Apr. 2009 which is hereby incorporated herein by reference.

TECHNICAL FIELD

The invention relates to the field of recreational sports where an individual stands on a rider-support surface of a board and rides the board through or atop of a medium such as air, snow or water. Particular embodiments provide binding systems which may be used to retain the individuals feet atop the rider-support surface.

BACKGROUND

Many recreational sports, such as snowboarding, for example, involve riding a board through or atop of a medium such as air, snow or water. A rider stands on one surface (the rider-support surface) of an elongated snowboard with his or her feet spaced apart from one another and oriented at various angles with respect to the longitudinal axis of the snowboard. The rider rides the board down snow covered inclined slopes with one foot in front of the other in a manner similar to that of surfing. Depending on whether the rider puts their right foot forward or their left foot forward, the rider's stance defines one edge of the snowboard to be the "heel side" or "heel edge" (i.e. the edge of the board closest to the rider's heels) and one edge of the snowboard to be the "toe side" or "toe edge" (i.e. the edge of the board closest to the rider's toes).

Snowboards typically incorporate bindings which may increase the rider's control over the board. Bindings typically retain the rider's feet atop the rider-support surface of the board and assist the rider to transfer his or her weight to the edges of the board and to thereby assist the rider to turn the board. There are many types of prior art snowboard bindings. Most prior art bindings incorporate a binding base plate or the like which is located on the rider-support surface of the board and is rigidly mounted to the board. The most common type of binding, referred to as a "high back" binding, incorporates a back member which projects from the binding base plate on the rider-support surface, such that the rider may lean backward (e.g. against the back member) to apply pressure to the heel edge of the board, and one or more straps which extend over top of the foot and bind the foot to the binding base plate, such that the rider may lean forward (e.g. against the straps) to apply pressure to the toe side of the board. Another common type of binding, referred to as the "step-in" binding, typically requires that the rider wear a hard shell boot which is secured to the binding base plate, such that the rider can apply pressure to the heel and toe edges of the snowboard by applying corresponding pressure against the interior surfaces of their hard shell boots. Step-in bindings use a variety of techniques for securing the hard shell boot to the binding base plate.

There is a general desire to improve the performance of prior art binding systems and/or to provide binding systems which offer new features over those of the prior art.

SUMMARY OF THE INVENTION

Aspects of this invention provide binding systems for recreational boards. The binding system is mounted atop a rider-support surface of the board. In some embodiments, at least a portion of the binding system is moveable (e.g. pivotal) with the rider's foot and with respect to the board. This relative motion between the ride's foot and the board may allow the rider to have greater control over the application of weight to the heel and/or toe edges of the board. In particular embodiments, the binding system comprises: a base rigidly mounted or mountable atop rider-support surface of the board; and a foot-retainer moveable (e.g. pivotally) mounted to the base via one or more movement joints (e.g. pivot couplings) for motion of the foot-retainer relative to the base and the board. The binding system may optionally comprise one or more deformable pads which may be located at points of contact between the foot-retainer and the board and/or at points of contact between the foot and the board. Such pads may be elastically deformable with corresponding movement of the foot-retainer. In some embodiments, the movement joints between the foot-retainer and the base may comprise deformable bushings, bias mechanisms or the like to dampen or otherwise cushion the relative motion between the foot-retainer and the base. Such bushings may be elastically deformable.

An aspect of the invention provides a binding system for retaining a rider's foot atop a recreational board, the binding system comprising: a base rigidly mountable to the recreational board; and a foot-retainer for retaining the rider's foot in generally fixed relation thereto, the foot-retainer moveably coupled to the base at one or more movement joints for motion of the foot-retainer and the rider's foot relative to the base and the recreational board.

Another aspect of the invention provides a recreational board comprising: a pair of bindings mounted atop a rider-support surface of the board, each binding comprising: a base rigidly mounted atop the rider-support surface of the recreational board; and a foot-retainer for retaining the rider's foot in generally fixed relation thereto, the foot-retainer moveably coupled to the base at one or more movement joints for motion of the foot-retainer and the rider's foot relative to the base and the recreational board.

Another aspect of the invention provides a kit comprising: a longitudinally elongated recreational board; and a pair of bindings mountable atop a rider-support surface of the board. Each binding comprises: a base rigidly mountable atop the rider-support surface of the recreational board; and a foot-retainer for retaining the rider's foot in generally fixed relation thereto, the foot-retainer moveably coupleable to the base at one or more movement joints for motion of the foot-retainer and the rider's foot relative to the base and the recreational board.

Another aspect of the invention provides a method for riding atop a rider-support surface of a recreational board. The method comprise: providing a pair of bindings mounted atop a rider-support surface of the board, each binding comprising: a base rigidly mounted atop the rider-support surface of the recreational board; and a foot-retainer moveably coupled to the base at one or more movement joints. The method also comprises the rider's feet into the foot-retainers of the bindings and configuring the foot-retainers to retain the rider's feet in generally fixed relation thereto; and for at least one of the bindings, asserting force against the foot-retainer using the corresponding rider's foot, the force asserted against the foot-retainer causing motion of the foot-retainer and the rider's foot relative to the base and the board.

Other aspects provide methods of operating, manufacturing and/or assembling binding systems for recreational boards wherein at least a portion of the binding system is pivotal with the rider's foot and with respect to the board.

Further features and applications of specific embodiments of the invention are described below.

BRIEF DESCRIPTION OF THE DRAWINGS

In drawings which depict non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Aspects of this invention provide binding systems for recreational boards. The binding system is mounted atop a rider-support surface of the board. In some embodiments, at least a portion of the binding system is moveable (e.g. pivotal) with the rider's foot and with respect to the board. This relative motion may allow the rider to have greater control over the application of weight to the heel and/or toe edges of the board. In particular embodiments, the binding system comprises: a base rigidly mounted atop rider-support surface of the board; and a foot-retainer moveably mounted or mountable to the base via one or more movement joints (e.g. pivot couplings) for motion of the foot-retainer relative to the base and the board. The binding system may optionally comprise one or more deformable pads which may be located at points of contact between the foot-retainer and the board and/or at points of contact between the foot and the board. Such pads may be elastically deformable with corresponding movement of the foot-retainer. In some embodiments, the movement joints between the foot-retainer and the base may comprise deformable bushings, bias mechanisms or the like to dampen or otherwise cushion the relative motion between the foot-retainer and the base. Such bushings may be elastically deformable.

Figure 1:
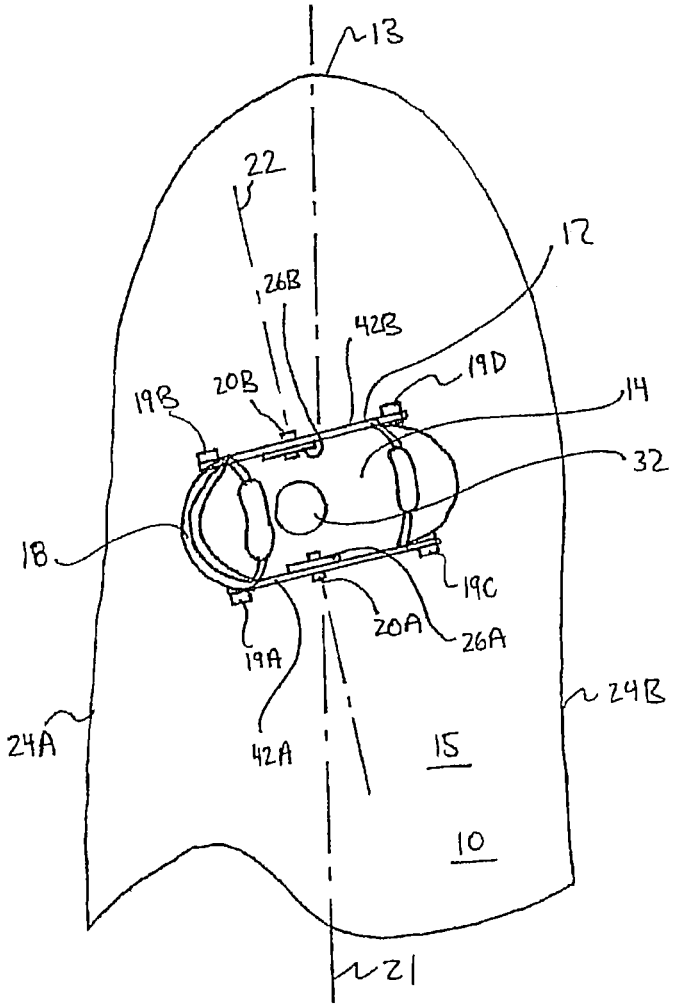
FIG. 1 is a top view of a portion of a recreational board and a binding system according to a particular embodiment of the invention.

FIG. 1 is a top view of the front portion of a recreational board 10 and a portion of a binding system 12 according to a particular embodiment. Recreational board 10 may be a snowboard or some other type of recreational board. Binding system 12 is mounted (or mountable) atop rider-support surface 15 of board 10. FIG. 1 shows only a front binding system 12 (i.e. the binding closest to the front 13 of board 10). Those skilled in the art will appreciate that snowboards and similar recreational boards typically comprise a pair of bindings and that the rear binding system may be generally similar to front binding system 12.

Binding system 12 comprises: a base 14, which may be rigidly mounted to board 10 (e.g. atop rider-support surface 15); and a foot-retainer 18, which is moveably mounted to base 14 at movement joints 20A, 20B (collectively, movement joints 20) for motion of foot-retainer 18 relative to base 14 and board 10. In the FIG. 1 embodiment, foot-retainer 18 is pivotally mounted to base 14 and movement joints 20 comprise pivot couplings which facilitate pivotal motion of foot-retainer 8 relative to base 14 and board 10 about pivot axis 22. For this reason, movement joints 20 of binding 12 (portions of which are shown in FIGS. 1-5) may be referred herein as pivot couplings 20 and the relative motion between foot-retainer 18 and base 14 may be referred to as pivotal motion, without loss of generality. In other embodiments, movement joints 20 may facilitate other types of relative movement, as described in more detail below. Foot-retainer 18 may retain a rider's foot (e.g. in a generally fixed relation to foot-retainer 18) such that the rider's foot moves (e.g. pivots) with foot-retainer 18 relative to base 14 and board 10. Binding system 12 may optionally comprise one or more deformable pads 19A, 19B, 19C, 19D (collectively, pads 19) which may be located at points of contact between foot-retainer 18 and board 10. Such pads 19 may be elastically deformable and may deform with corresponding movement of foot-retainer 18.

Foot-retainer 18 may retain the rider's foot, such that the rider's foot is generally fixed in relation to, and moves with, foot-retainer 18 (relative to board 10 and base 14) about pivot axis 22. The pivotal motion of foot-retainer 18 and the corresponding pivotal motion of the rider's foot with respect to board 10 and base 14 and allows the rider greater control over the transfer of weight to heel edge 24A and/or to toe edge 24B (collectively, edges 24) of board 10. By way of non-limiting example, in comparison to rigidly mounted (i.e. non-moveable) bindings, the pivotal motion of foot-retainer 18 may provide a rider with increased control by allowing the rider to increase the amount of force/weight transferred to edge(s) 24, to decrease the amount of effort required to transfer a given amount of force/weight to edge(s) 24 or the like. This greater control in turn provides greater rider comfort, less fatigue.

This description and the accompanying claims use a number of directional conventions to clarify their meaning:

(i) "front", "forward", "forwardly", "forwardmost" and similar words are used to refer to directions that are generally oriented towards the front 13 of board 10 (FIG. 1);

(ii) "back", "backward", "rear", "rearward", "rearwardly", "rearwardmost" and similar words are used to refer to directions that are generally oriented away from the front 13 of board 10 (i.e. opposite the forward direction);

(iii) "longitudinal" and "longitudinally" and similar words are used to refer to either or both of the forward and rearward directions;

(iv) "transverse", "transversely" and similar words refer to directions that are generally orthogonal to the longitudinal direction and generally in the plane of snowboard 10 (e.g. toward either or both of heel edge 24A and toe edge 24B);

(v) "up", "upper", "upward", "upwardly", "upwardmost" and similar words are used to refer to a direction that extends from a center of board 10 towards rider-support surface 15 and beyond (i.e. out of the page toward the reader in FIG. 1);

(vi) "low", "lower", "down", "downward", "downwardly", "downwardmost" and similar words refer to a direction that is opposite the upward direction; and (vii) "vertical", "vertically" or similar words refer to either or both of the upward and downward directions.

Those skilled in the art will appreciate that directional conventions used in this description and the accompanying claims depend on the specific orientation of board 10 and binding system 12. Accordingly, these directional terms are not strictly defined and should not be interpreted narrowly.

Figure 2A:
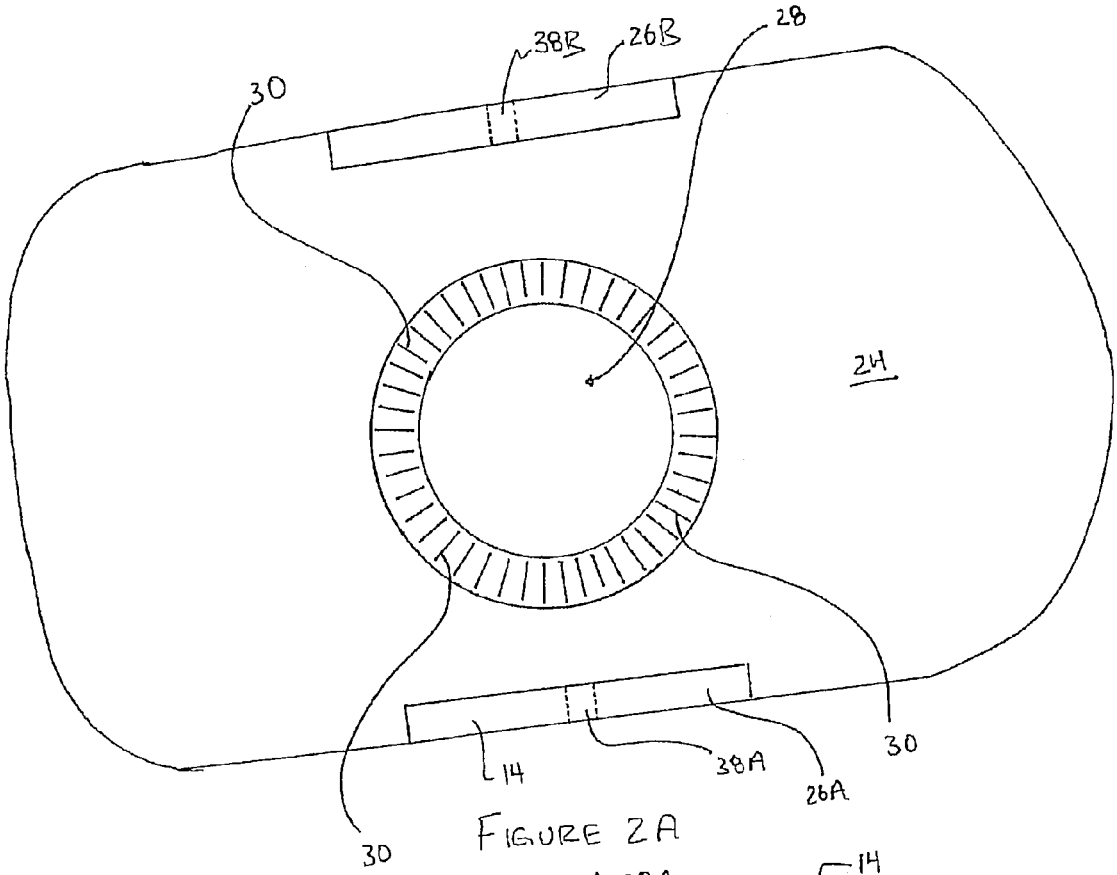
FIGS. 2A, 2B and 2C (collectively, FIG. 2) are plan views of the base of the FIG. 1 binding according to a particular embodiment taken from a top of the base 14, a rear of the base and from a toe-side of the base respectively.
Figure 2B:
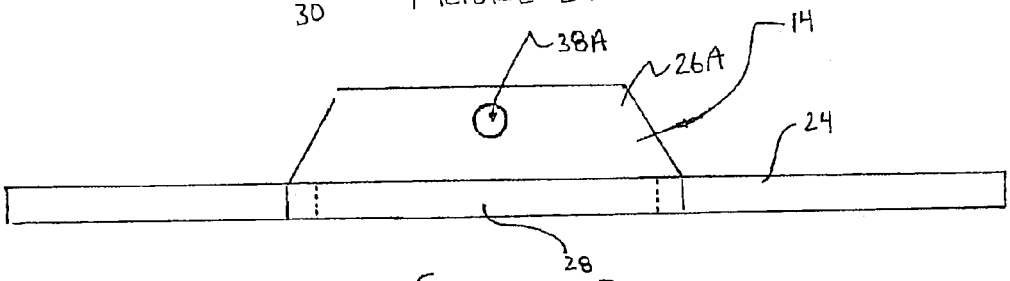
Figure 2C:
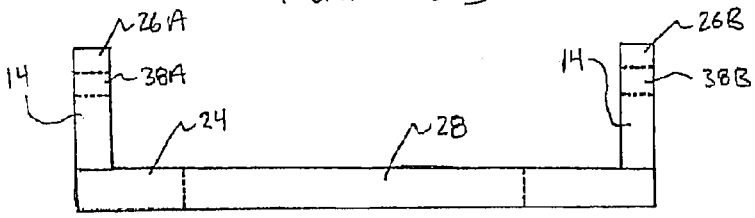

FIGS. 2A-2C respectively show more detailed plan views base 14 according to a particular embodiment (i.e. from a top of base 14 (FIG. 2A), from the rear of base 14 (FIG. 2B) and from a toe-side of base 14 (FIG. 2C)). Base 14 is rigidly mountable atop rider-support surface 15 of board 10. In the illustrated embodiment, base 14 comprises a base plate 24 which is mountable atop rider-support surface 15 of board 10 and a pair of stand-off flanges 26A, 26B (collectively, stand-off flanges 26) that extend upwardly from base plate 24 at opposing sides thereof to locate pivot couplings 20 at locations spaced upwardly apart from the lowermost portion of binding 12 and spaced upwardly apart from rider-support surface 15 of board 10. As shown in the illustrated embodiment, base plate 24 may be at least roughly shaped like the bottom of a rider's foot (or footwear)). This is not necessary, however, and base plate 24 may have other suitable shapes (e.g. generally round, generally oval, generally rectangular or any other suitable shape) capable of providing the functionality described herein.

Figure 3:
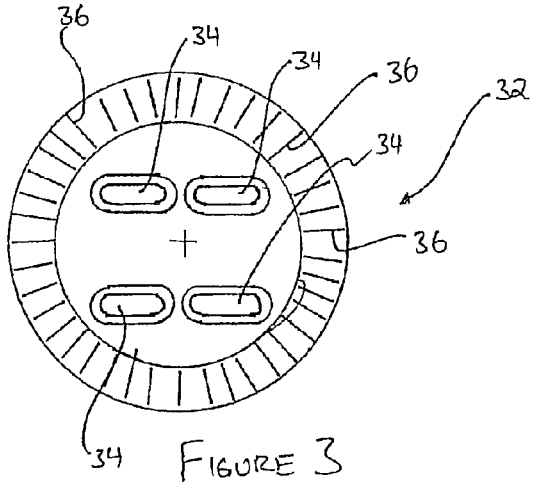
FIG. 3 is a bottom view of a mounting disc which may be used to mount the FIG. 2 base atop the rider-support surface of the FIG. 1 board.

In the illustrated embodiment, base plate 24 comprises a generally circular cut-out 28 with upwardly and radially extending ridges 30 around a perimeter thereof. Cut-out 28 permits base 14 to be rigidly mounted atop rider-support surface 15 of board 10 using a mounting disc 32 (FIG. 3). The use of mounting disc 32 to mount base 14 atop recreational board 10 may be similar to well known prior art technique of using a mounting disc to mount the binding base plate to a snowboard. In the illustrated embodiment, mounting disc 32 defines a plurality of fastener receiving apertures 34 and is sized to be slightly larger than cut-out 28. Mounting disc 32 may be placed atop cut-out 28 in a desired location on board 10 and suitable fastener components (e.g. screws or the like) may be inserted through apertures 34, through cut-out 28 and into corresponding fastener components (e.g. threaded receptacles) in board 10. Tightening the fastener components causes mounting disc 32 to exert pressure against base plate 24 to thereby rigidly mount base plate 24 atop rider-support surface 15 of board 10.

Mounting disc 32 may comprise a plurality of downwardly and radially extending ridges 36 around a perimeter thereof. Such ridges 36 may interact with corresponding radially and upwardly extending ridges 30 around the perimeter of cut-out 28 to permit pivotal adjustment of base 14 about a vertical axis relative to board 10 when the fastener components are loose or removed. When the fastener components are tightened, interaction of ridges 30, 36 may prevent (or at least mitigate against) movement of base 14 relative to board under the occasionally high torques associated with riding a recreational board. The longitudinal location of base 14 atop rider-support surface 15 of board 10 may be adjusted by decoupling the fastener components that project through apertures 34 from the fastener components in board 10, moving base 14 and mounting disc 32 to a new longitudinal location atop board 10 and re-coupling the fastener components that project through apertures 34 into a new set of fastener components in board 10. Board 10 may be provided with a plurality of longitudinally spaced apart sets of fastener components to facilitate such longitudinal adjustment.

The above-described system using cut-out 28 and mounting disc 32 represents one non-limiting embodiment for rigidly mounting base 14 atop rider-support surface 15 of board 10 and permitting adjustment of the position and/or orientation of base 14 relative to board 10. In other embodiments, other systems and/or modified versions of the above-described system may be used to rigidly mount base 14 atop rider-support surface 15 of board 10 and/or to permit adjustment of the position and/or orientation of base 14 relative to board 10. For example, base 14 (including base plate 24 and/or stand-off flanges 26) may be mounted to board 10 using a channel provided in board 10 and corresponding fasteners similar to those marketed by Burton Snowboards (The Burton Corporation) under the product line EST™.

Returning to FIG. 2, base 14 of the illustrated embodiment comprises stand-off flanges 26. In the FIG. 2 embodiment, flanges 26 extend upwardly from base plate 24 at opposing sides thereof to locate pivot couplings 20 at locations spaced upwardly from rider-support surface 15. In some embodiments, base 14 may comprise stand-off flanges 26 without base plate 24 or stand-off flanges 26 may be provided separately from base plate 24 (e.g. as separate components). In such embodiments, stand-off flanges 26 may extend upwardly directly from board 10 to locate pivot couplings 20 at locations spaced upwardly apart from rider-support surface 15. In the illustrated embodiment, stand-off flanges 26A, 26B are respectively penetrated by apertures 38A, 38B (collectively, apertures 38). Apertures 38 may support, and/or provide one or more portions of, pivot couplings 20. In particular embodiments where apertures 38 provide one or more portions of pivot couplings 20, the bore surfaces of apertures 38 may provide portions of the bearing surfaces of suitably configured pivot pins of pivot couplings 20. In such embodiments, the cross-sectional shapes of apertures 38 may be generally circular. In other embodiments, apertures 38 may be replaced by (or used to accommodate or support) one or more components of pivot couplings 20. In such embodiments, pivot couplings 20 may comprise components which themselves are pivotable with respect to one another. In such embodiments, the cross-sectional shapes of apertures 38 may be non-circular.

Figure 7A:
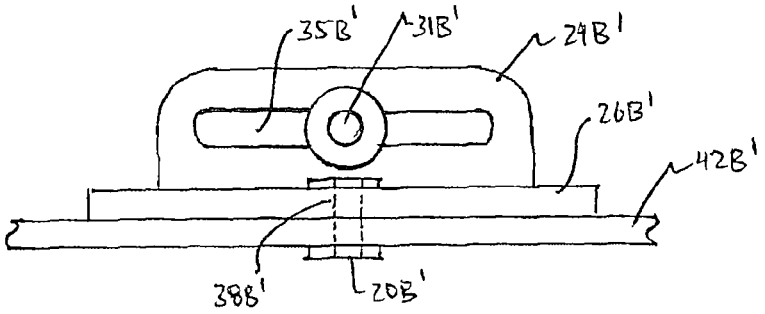
FIGS. 7A and 7B are respectively partial top and partial rear views of a binding system according to another embodiment of the invention with the strapping system removed for clarity.
Figure 7A:
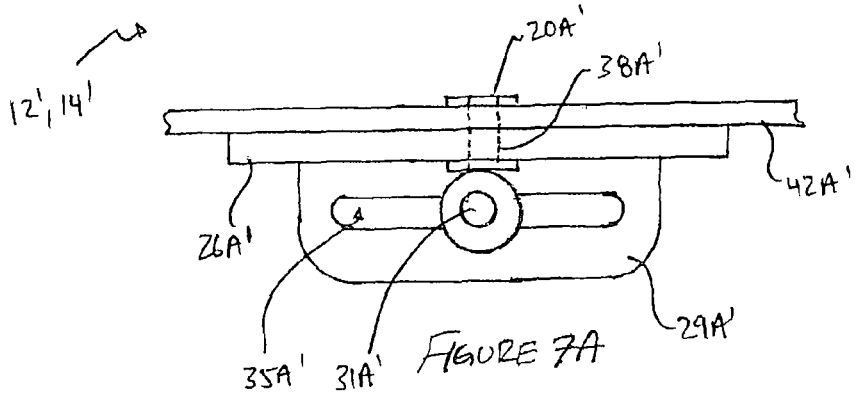
Figure 7B:
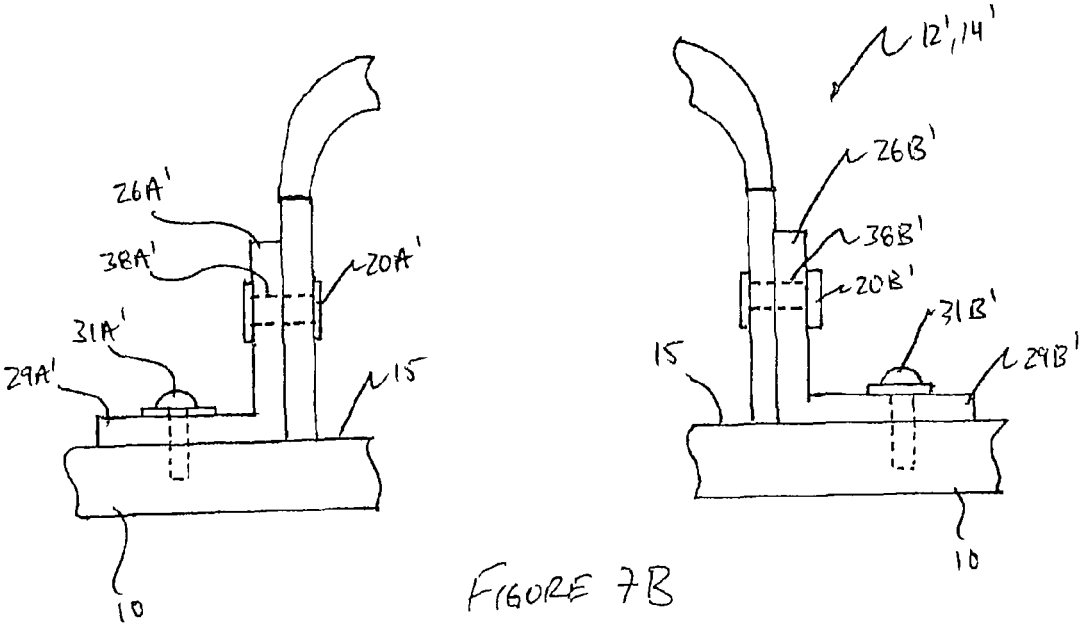

In the illustrated embodiment of FIGS. 1-5, base plate 24 extends between stand-off flanges 26A, 26B. This is not necessary. In some embodiments, base 14 comprises stand-off flanges 26 without base plate 24. In such embodiments, which may reduce the weight of binding 12, the rider's foot (or footwear) may be retained directly against rider-support surface 15. In still other embodiments, stand-off flanges 26 and base plate 24 may be provided as separate components FIGS. 7A and 7B show plan views (from above and from the toe-side) of a binding 12' according to another embodiment. Binding 12' is similar in many respects to binding 12' of FIGS. 1-5 and features of binding 12' which are similar to corresponding features of binding 12 are described with similar reference numerals annotated with the prime (') symbol. Binding 12' differs from binding 12 primarily in that base 14' of binding 12' comprises a pair of stand-off flanges 26A', 26B' (collectively, stand-off flanges 26'), but does not include a base plate. In the embodiment of FIGS. 7A and 7B, stand-off flanges 26' are rigidly mounted to board 10 such that stand-off flanges 26' project upwardly from rider-support surface 15 to locate corresponding movement joints 20A', 20B' (collectively, movement joints 20') at locations spaced upwardly apart from rider-support surface 15 of board 10 and/or spaced upwardly apart from a lowermost part of binding 12'. In the illustrated embodiment of FIGS. 7A and 7B, movement joints 20' comprise pivot couplings 20' and may be referred to as pivot couplings 20'. Pivot couplings 20' of binding 12' may be similar to pivot couplings 20 of binding 12. Stand-off flanges 26' may comprise apertures 38A', 38B' (collectively, apertures 38') which may support, or provide portions of, pivot couplings 20' in a manner similar to apertures 38 of binding 12.

In the illustrated embodiment of FIGS. 7A and 7B, each stand-off flange 26 is provided with a corresponding mounting flange 29A', 29B' (collectively, mounting flanges 29'). Mounting flanges 29' may extend in a plane generally parallel to that of board 10 and may abut against rider-support surface 15. One or more suitable fasteners (e.g. screws, bolts, rivets or the like) 31A', 31B' (collectively, fasteners 31') may project through one or more corresponding apertures 35A', 35B' (collectively, apertures 35') in each of mounting flanges 29' to mount stand-off flanges 26' atop rider-support surface 15. In some embodiments, apertures 35' may be elongated to permit adjustment of the locations and/or orientation of stand-off flanges 26'. In some embodiments, apertures 35' may comprise suitably shaped projections similar to projections 68, 70 of apertures 44 (described below) which may define corresponding retaining locations for the projection of fasteners 31' through apertures 35'. In some embodiments, rear stand-off flange 26A' may be provided with a corresponding mounting flange 29A' that projects rearwardly from rear stand-off flange 26A' and front stand-off flange 26B' may be provided with a corresponding mounting flange 29B' that projects forwardly from front stand-off flange 26B'. Such embodiments, may have the advantage that mounting flanges 29' extend away from (e.g. are not located under) the rider's foot when the rider's foot is located between stand-off flanges 26'. However, this is not necessary. In some embodiments, rear mounting flange 29A' may project in other directions (e.g. forwardly) from rear stand-off flange 26A' and forward mounting flange 29B' may project in other directions (e.g. rearwardly) from forward stand-off flange 26B'.

Binding 12' of FIGS. 7A and 7B also differs from binding 12 in that rails 42A', 42B' (collectively, rails 42') are located inwardly of (i.e. closer to the rider's foot than) stand-off flanges 26'. More particularly, rearward rail 42A' is located forwardly of rearward stand-off flange 26A' and forward rail 42B' is located rearwardly of forward stand-off flange 26B'. This difference is discussed in more detail below.

Returning to binding 12 of FIGS. 1-5, FIGS. 4A-4C respectively depict side, top and front views of binding 12 including both base 14 and foot-retainer 18. For clarity, strapping system 47 (which is described in more detail below) is omitted from FIGS. 4B and 4C. In the illustrated embodiment, foot-retainer 18 comprises: a heel retainer 40 which receives the rider's heel; rearward and forward rails 42A, 42B (collectively, rails 42) which extend transversely from heel retainer 40 toward toe edge 24B along the rearward and forward sides of the rider's foot (e.g. adjacent to rearward and forward stand-off flanges 26); and a strapping system 47 which includes one or more straps which retain the rider's foot in heel retainer 40 and between rails 42.

In the illustrated embodiment, heel retainer 40 comprises a high back portion 41 and a heel cup 45. High back portion 41 and heel cup 45 may be similar in many respects to the high backs and heel cups used in prior art snowboard bindings. High back portion 41 and heel cup 45 may have concave surfaces that open toward toe edge 24B to accommodate the convex surfaces of the heel portion of a rider's foot/footwear.

High back portion 41 may extend upwardly towards the rider's calf, such that the rider may apply force against high back portion 41 and heel edge 24A using their calf. High back portion 41 may be rigidly mounted to heel cup 45 or may be pivotally mounted to heel cup 45 (e.g. at pivot joints 58, only one of which is shown in the illustrated views). Embodiments where high back 41 is pivotally mounted to heel cup 45, may comprise a mechanism (e.g. a pivot stop mechanism) for limiting the pivotal movement of high back portion 41 away from toe edge 24B and rider-support surface 15 and thereby limiting the angular orientation of high back portion 41 relative to rails 42. For example, such a pivot stop mechanism may comprise a protrusion from high back 41 toward heel edge 24A which limits the pivotal movement of high back portion 41 to the configuration shown in FIG. 4A. Such a pivot stop mechanism may be rider-adjustable to permit the rider to control the angular orientation of high back portion 41 relative to rails 42.

In the illustrated embodiment, heel cup 45 comprises a cross-portion 33 which crosses binding 12 and heel cup 45 comprises spaced-apart legs 45A, 45B (collectively, legs 45) which extend downwardly to respective rails 42A, 42B, thereby providing aperture 43 on the heel side of binding 12. In the illustrated embodiment, heel cup 45 is integrally formed with rails 42 or is rigidly joined to rails 42 at spaced apart legs 45A, 45B. This is not necessary. In some embodiments, heel cup 45 may be pivotally mounted to rails 42 (e.g. at legs 45) for limited pivotal movement of heel cup 45 with respect to rails 42.

Strapping system 47 (FIG. 4A) comprises one or more straps which may extend over top of a rider's foot for retaining the rider's foot between rails 42. Strapping system 47 may also help to retain the rider's foot against heel retainer 40. Strapping system 47 may extend between opposing (e.g. forward and rearward) sides of heel retainer 40 and/or between opposing (e.g. forward and rearward) rails 42.

In the illustrated embodiment, strapping system 47 comprises a pair of straps 48A, 48B (collectively, straps 48) which may be similar in many respects to the straps used in prior art snowboard bindings. Straps 48 of the illustrated embodiment are adjustable to an open configuration (not shown) wherein the rider may insert their foot into, or remove their foot from, binding 12 and adjustable to a variety of rider-adjustable closed configurations wherein the rider's foot is retained between rails 42. In the illustrated embodiment, straps 48 may also retain the rider's foot against heel retainer 40 when straps 48 are in their closed configurations. Straps 48 of the illustrated embodiment respectively comprise: first strap portions 50A, 50B (collectively, first strap portions 50); second strap portions 54A, 54B (collectively, second strap portions 54); and lock/adjustment mechanism 52A, 52B (collectively, lock mechanism 52).

Lock/adjustment mechanisms 52 may be mounted on second strap portions 54 and may interact with first strap portions 50 to connect first strap portions 50 to second strap portions 54. In the illustrated embodiment, first strap portions 50 may comprise ridges 56A, 56B (collectively, ridges 56) which extend transversely thereacross and which may be engaged by a corresponding pawl (not shown) in lock/adjustment mechanism 52. Strap portions 50 having such ridges 56 may be referred to as ladder straps 50. In some embodiments, lock/adjustment mechanisms 52 may comprise a ratcheting mechanism (not shown) for tightening ladder straps 50 and a release mechanism (not shown) for releasing ladder strap 50. In other embodiments, other techniques may be used to facilitate the interaction between lock mechanisms 52 and first strap portions 50. Non-limiting examples of such other techniques comprises pivoting buckles or the like.

In the illustrated embodiment, second strap portions 54 comprise pads 55A, 55B (collectively, pads 55) which may distribute some of the pressure that may be applied to the top of the rider's foot. Pads 55 are not necessary.

Strapping system 47 may be mounted to one or more of the other parts of foot-retainer 18 (e.g. to heel retainer 40 and/or to rails 42), such that strapping system 47 moves with foot-retainer 18 when it pivots (at pivot couplings 20) relative to base 14, as explained in more detail below. In the illustrated embodiment, strap 48A is pivotally mounted to rails 42 at pivot joints 58 and strap 48B is pivotally mounted to rails 42 at pivot joints 60. It should be noted that only one pivot joint 58 and one pivot joint 60 (which mount first strap portions 50 to rail 42A) are shown in the illustrated views, but that there are similar pivot joints (not shown) which mount second strap portions 54 to rail 42B. In other embodiments, one or more parts of strapping system 47 may be mounted to heel retainer 40. Pivot joints 58, 60 allow straps 48 to be pivotally adjustable relative to rails 42 (i.e. for rider comfort or the like), but straps 48 move with foot-retainer 18 when it pivots (at pivot couplings 20) relative to base 14, as explained in more detail below.

Figure 4A:
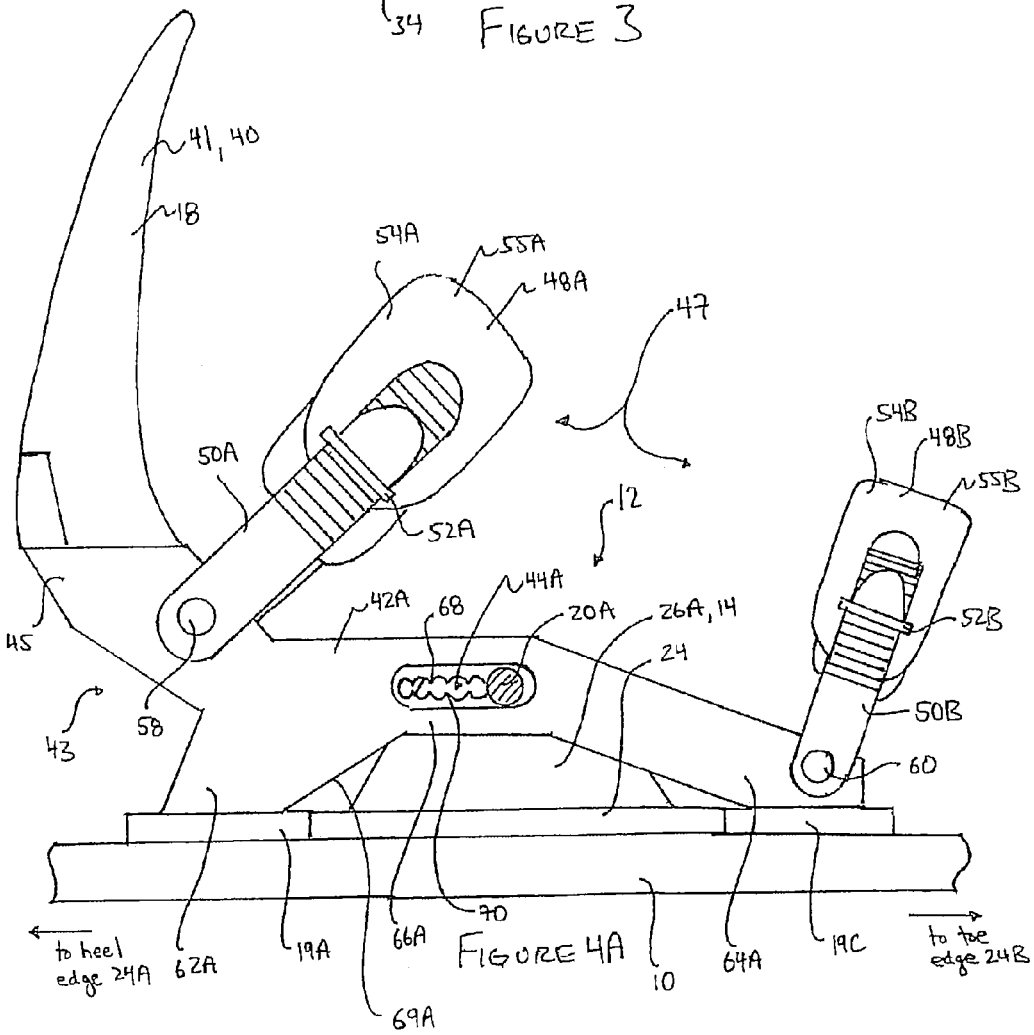
FIG. 4A is a rear plan view of the FIG. 1 binding system showing the strapping system thereof.
Figure 4B:
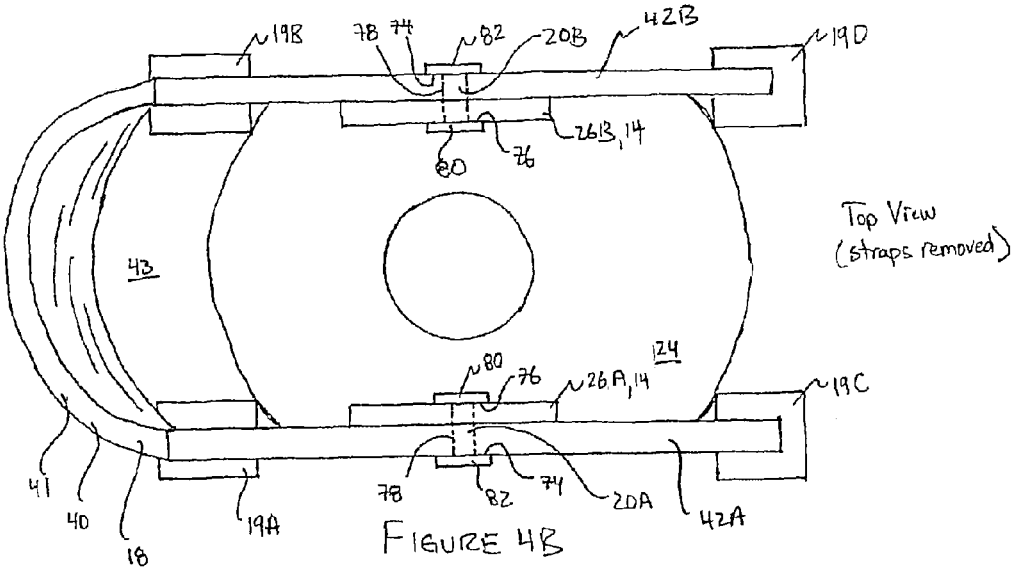
FIGS. 4B and 4C are respectively partial top and partial toe-side views of the FIG. 1 binding system with the strapping system removed for clarity.
Figure 4C:
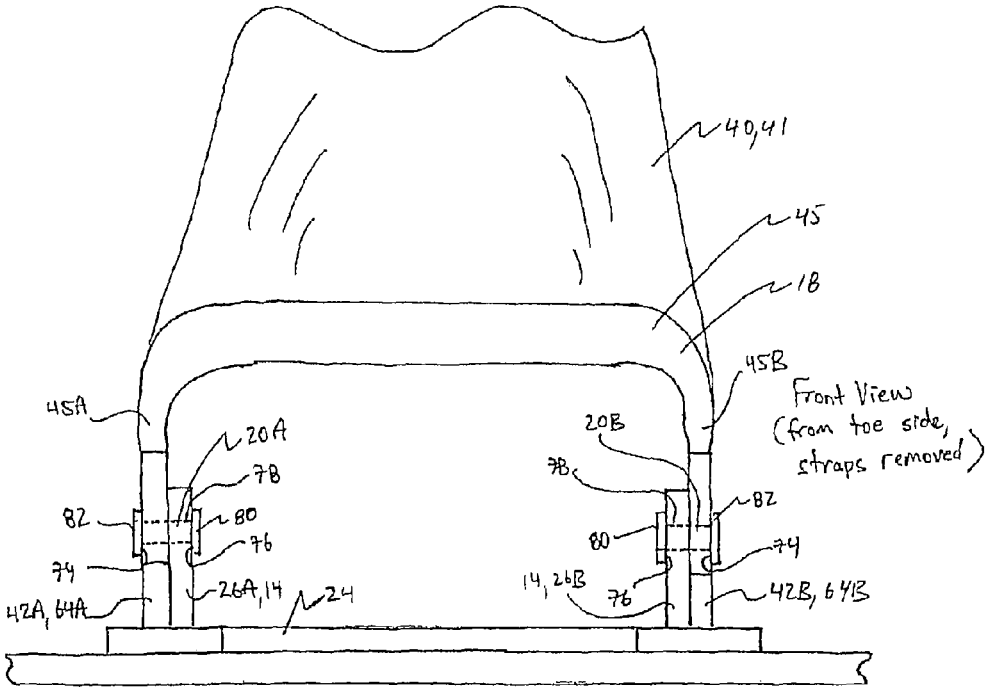

Strapping system 47 shown in FIG. 4A represents one non-limiting embodiment of a strapping system 47 which may extend over top of a rider's foot to retain a rider's foot between rails 42 in binding 12. In other embodiments, strapping system 47 may accommodate a wide variety of modifications, additions or alternatives, such as, by way of non-limiting example:

- strapping system 47 may comprise a different number of straps;
- strapping system 47 may comprise deformable straps (e.g. that stretch or otherwise deform to allow a rider to insert their foot into binding 12;
- strapping system 47 may comprise a different mechanism which allows strapping system 47 to adjust to an open configuration (such that the rider can insert their foot into binding 12) and which allows strapping system 47 to adjust to one or more closed configurations wherein the rider's foot is retained;
- strapping system 47 may comprise straps 48 with different shapes—e.g. toe strap 48B may be provided with a toe cup which extends downwardly on the toe side of the user's toes;
- strapping system 47 may comprise a system similar to those marketed by Flow Snowboarding (USA) and UVEX TOKO Canada Ltd. under their Flow™ binding system; and the like.

Foot-retainer 18 also comprises rails 42. Rails 42 of the embodiment shown in FIGS. 1-5 are moveably (e.g. pivotally) mounted to stand-off flanges 26 of base 14 at movement joints 20 (e.g. pivot couplings 20) to permit movement (e.g. pivotal movement) of rails 42 relative to board 10 and base 14. In the illustrated embodiment of FIGS. 1-5, rails 42 are pivotally movable with respect to board 10 and base 14 about pivot axis 22. Rails 42 may extend upwardly (away from rider-support surface 15) and along the rearward and forward sides of the rider's foot (e.g. adjacent to rearward and forward stand-off flanges 26) to help retain the rider's foot in binding 12. In the illustrated embodiment, each rail 42 comprises a corresponding downwardly extending heel-side leg 62A, 62B (collectively, heel-side legs 62) and each rail 42 comprises a corresponding downwardly extending toe-side leg 64A, 64B (collectively, toe-side legs 64). Heel-side legs 62 may extend downwardly at or near the heel side of rails 42 to contact pads 19A, 19B. Toe-side legs 64 may extend downwardly at or near the toe side of rails 42 to contact pads 19C, 19D. Rails 42 may comprise central portions 66A, 66B (collectively, central portions 66) located between heel-side and toe-side legs 62, 64. The shape of rails 42 (including heel-side legs 62, toe-side legs 64 and central portions 66) may provide rails 42 with concave lower edges 69A, 69B (collectively, concave lower edges 69) which open downwardly (i.e. toward rider-support surface 15). It will be appreciated that the illustrated views only shown one such concave lower edge 69A (FIG. 4A), but that the other concave lower edge 69B may be substantially similar.

While the shape of rails 42 shown in the illustrated embodiment (i.e. downwardly extending legs 62, 64 and concave lower edges 69) may assist with, and/or permit a greater range of pivotal motion, of rails 42 at pivot couplings 20, this shape is not necessary and the profile of the lower edges of rails 42 may be provided with other shapes (e.g. a relatively flat or the like).

Rails 42 of the embodiment shown in FIGS. 1-5 are pivotally mounted to base 14 (e.g. to stand-off flanges 26) at pivot couplings 20 to permit pivotal movement of rails 42 relative to base 14 and board 10 about pivot axis 22. In the illustrated embodiment, pivot couplings 20 are coupled to (or otherwise provided in) central portions 66 of rails 42 at locations which are spaced apart from rider-support surface 15. In some embodiments, pivot couplings 20 are located in a range of 0.5 cm-10 cm from rider-support surface 15 (or from the lowermost extent of binding 12). In particular embodiments, pivot couplings 20 are located in a range of 1.0 cm-5 cm from rider-support surface 15 (or from the lowermost extent of binding 12). In still other embodiments, pivot couplings 20 are located in a range of 1.5 cm-4 cm from rider-support surface 15 (or from the lowermost extent of binding 12). Rails 42 may be shaped to accommodate this desired spacing.

In the illustrated embodiment, rails 42 comprise apertures 44A, 44B (collectively, apertures 44). Apertures 44 may form portions of, or otherwise accommodate or support, pivot couplings 20 between rails 42 and base 14 at locations spaced upwardly apart from rider-support surface 15. In particular embodiments, portions of the bore surfaces of apertures 44 may provide portions of the bearing surfaces of suitably configured pivot pins of pivot couplings 20. In other embodiments, apertures 44 may be replaced by (or used to accommodate or support) one or more components of other types of pivot couplings 20. In such embodiments, the cross-sectional shapes of apertures 44 may be non-circular.

In the illustrated embodiment of FIGS. 1-5, apertures 44 are generally elongated in a transverse direction which may facilitate transverse adjustment of rails 42 relative to base 14 and pivot couplings 20. In the illustrated embodiment, the upper edges of apertures 44 comprise downwardly extending projections (e.g. teeth) 68 and the lower edges of apertures 44 comprise upwardly extending projections (e.g. teeth) 70. Together, a pair of downwardly extending projections 68 and a pair of upwardly extending projections 70 may provide a retaining location for pivot coupling 20 as it projects through aperture 44. Projections 68, 70 may be shaped such that the retaining locations formed thereby are semi-circularly shaped. This cross-sectional shape of projections 68, 70 permits rails 42 to bear against and slide relative to hinge pins 78 of pivot couplings 20, as described in more detail below.

The transversely elongated shape of apertures 44 is not required. In some embodiments, apertures 38 of stand-off flanges 26 may be provided with a transversely elongated shape, in which case, apertures 44 may be provided with non-elongated shapes. In some embodiments, the transversely elongated shape of apertures 44 (or apertures 38) may be replaced with a plurality of transversely spaced apart apertures which may be used to adjust the transverse position of rails 42 relative to base 14 and pivot couplings 20. In some embodiments, transverse adjustment of rails 42 relative to base 14, board 10 and pivot couplings 20 is not required, in which case apertures 44 may be non-elongated in shape.

In the illustrated embodiment of FIGS. 1-5, rails 42 are located on the outsides of (i.e. further from the rider's foot than) stand-off flanges 26. More particularly, as shown best in FIG. 4B, rearward rail 42A is located rearwardly of rearward stand-off flange 26A and forward rail 42B is located forwardly of forward stand-off flange 26B. This is not necessary. In general, rails 42 may be located inwardly of (i.e. closer to the riders foot than) stand-off flanges 26. This configuration, is shown for example in binding 12' of FIGS. 7A and 7B, where rails 42' are located inwardly of (i.e. closer to the rider's foot than) stand-off flanges 26'. More particularly, rearward rail 42A' is located forwardly of rearward stand-off flange 26A' and forward rail 42B' is located rearwardly of forward stand-off flange 26B'.

Movement joints 20 of the embodiment shown in FIGS. 1-5 comprise pivot couplings 20. As shown best in FIGS. 4B and 4C, pivot couplings 20 of the embodiment shown in FIGS. 1-5 comprise a pair of pivot-coupling components 80, 82 which extend through apertures 38, 44 and join together to provide hinge pins 78. For example, in one non-limiting embodiment, hinge pin 78 is part of pivot-coupling component 82 which comprises a threaded bore that is axially aligned with hinge pin 78 on an interior thereof and pivot-coupling component 80 comprises a threaded shaft which threadably extends into the threaded bore to complete pivot coupling 20.

Hinge pins 78 may have a substantially circular cross-section. In this embodiment, one or both rails 42 and base 14 may pivot relative to hinge pins 78. For example, apertures 38 may be provided with a substantially circular cross-section, such that the edge(s) of apertures 38 bear on, and slide relative to, hinge pins 78 to allow relative pivotal motion between hinge pins 78 and stand-off flanges 26. Similarly, hinge pins 78 may bear on, and slide relative to, the edges of apertures 44 to allow relative pivotal motion between hinge pins 78 and rails 42. In some embodiments, the semi-circular cross-sectional shape provided by projections 68, 70 may allow the edges of projections 68, 70 to bear on, and slide relative to, hinge pins 78.

Pivot couplings 20 of the illustrated embodiment represent one particular non-limiting type of pivot coupling 20. In other embodiments, pivot couplings 20 may comprise any suitable pivot joints which facilitate pivotal movement of rails 42 relative to base 14 (e.g. stand-off flanges 26) about pivot axis 22.

In some embodiments, pivot couplings 20 may comprise internal pivot joints (e.g. internal bearing surfaces, internal ball-bearing races or the like) which permit pivot-coupling components 80, 82 (or other pivot-coupling components) to pivot relative to another to facilitate the pivotal movement of rails 42 relative to base 14. In such embodiments, the internal pivot mechanisms of pivot couplings 20 permit rails 42 to be fixed (in non-pivoting relationships) to pivot-coupling components 82 and base 14 to be fixed (in non-pivoting relationships) to pivot coupling components 80. In such embodiments, the cross-sectional shapes of apertures 38 (of base 14) and 44 (of rails 42) may be non-circular in shape to maintain these fixed (non-pivoting relationships). In some embodiments, such non-circular cross-sections may be provided by suitably shaped projections similar to projections 68, 70 (FIG. 4A). Similarly, in such embodiments, the portion 78 of pivot couplings 20 that extends between flanges 74, 76 of pivot-coupling components 82, 80 may have a non-circular cross-section.

Additionally or alternatively, in such embodiments, central portions 66 of rails 42 may be provided with ridges around a perimeter of transversely elongated apertures 44 which may engage corresponding ridges on flanges 74 of pivot-coupling components 82. Stand-off flanges 26 of bases 14 may be provided with similar ridges around apertures 38 for engaging similar ridges on the flanges of pivot-coupling components 80. Such ridges may interact with one another in a manner similar to ridges 36 of mounting disc 32 and ridges 30 of base plate 24. In addition to helping to maintain a non-pivoting relationship between rails 42 and pivot couplings 20 and between base 14 and pivot couplings 20, the interaction of these ridges may help to retain pivot couplings 20 in a particular transverse location within transversely elongated apertures 44. In some embodiments, these ridges may assist projections 68, 70 to retain pivot couplings 20. In other embodiments, these ridges may be used in the place of projections 68, 70 to retain pivot couplings 20.

Figure 5A:
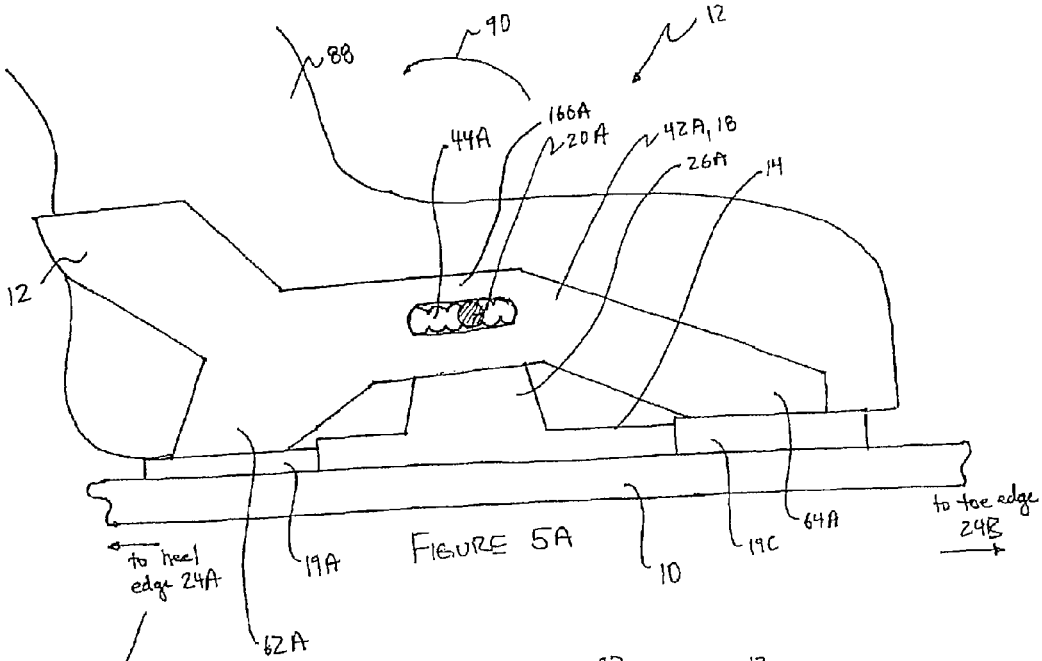
FIGS. 5A and 5B respectively depict the operation of the FIG. 1 binding system to apply force to the heel-side edge and the toe-side edge of the FIG. 1 board.
Figure 5B:
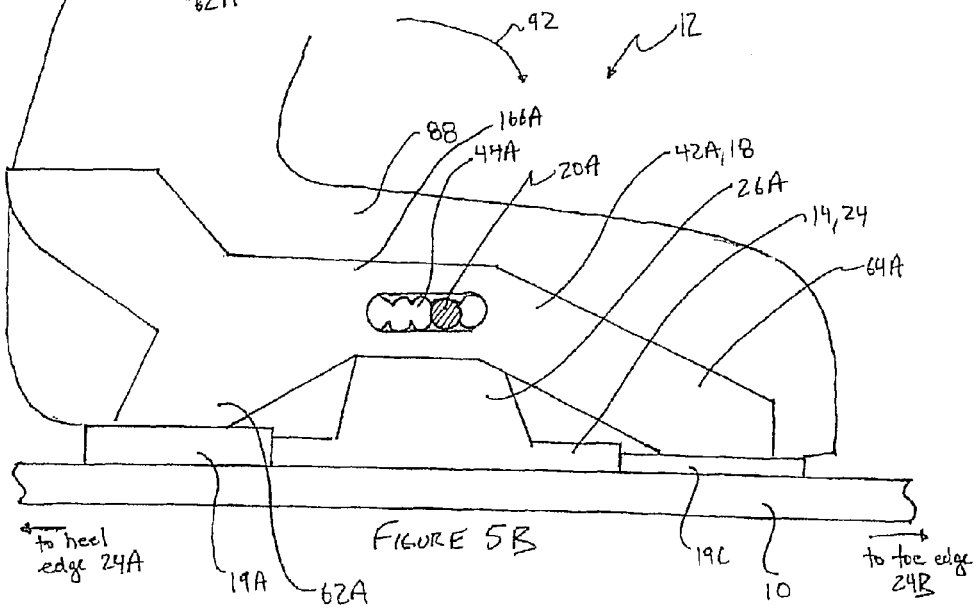

The operation of binding 12 is illustrated in FIGS. 5A and 5B which show a portion of binding 12 with a rider's foot 88 retained therein. As discussed above, the rider's foot 88 is retained in foot-retainer 18, such that when the rider applies force to foot-retainer 18 (using their foot 88), foot-retainer 18 moves (e.g. pivots) with respect to base 14 and board 10 at movement joints (e.g. pivot couplings 20). The motion (e.g. pivotal motion) of foot-retainer 18 and the corresponding motion (e.g. pivotal motion) of the rider's foot with respect to base 14 and/or board 10 allows the rider greater control over the transfer of weight to heel edge 24A and/or to toe edge 24B (collectively, edges 24) of board 10.

In FIG. 5A, a rider is applying force to their foot 88 (and/or other parts of their body) which would tend to increase the force on heel edge 24A of board 10. In such a configuration, foot 88 (and/or other parts of the rider's body) apply force to foot-retainer 18 (e.g. against heel retainer 40 and/or strapping system 47) and these forces tend to pivot foot-retainer 18 with respect to base 14 and/or board 10 in the angular direction indicated by arrow 90. When foot-retainer 18 pivots in this manner, it tends to compress pads 19A and 19B (i.e. the pads 19 closest to heel edge 24A) and, in some embodiments, may permit pads 19C and 19D (i.e. pads 19 closest to toe edge 24B) to expand. The pivotal motion of foot-retainer 18 (relative to base 14 and/or board 10) in direction 90 allows the rider greater control over the transfer of weight to heel edge 24A.

In FIG. 5B, the rider is applying force to their foot 88 (and/or other parts of their body) which would tend to increase the force on toe edge 24B of board 10. In such a configuration, foot 88 (and/or other parts of the rider's body) apply force to foot-retainer 18 (e.g. against strapping system 47) and these forces tend to pivot foot-retainer 18 with respect to base 14 and/or board 10 in the angular direction indicated by arrow 92. When foot-retainer 18 pivots in this manner, it tends to compress pads 19C and 19D (i.e. pads 19 closest to toe edge 24B) and, in some embodiments, may permit pads 19A and 19B (i.e. the pads 19 closest to heel edge 24A) to expand. The pivotal motion of foot-retainer 18 (relative to base 14 and/or board 10) in direction 92 allows the rider greater control over the transfer of weight to toe edge 24B.

Pads 19 may be fabricated from any suitable resilient material which may be deformed (e.g. compressed) under the forces associated with the operation of pivotal operation of binding 12 as described above. Pads 19 may be fabricated from a material which tends to elastically restore itself (e.g. to expand) to its original shape and size when such forces are removed or reduced. Suitable materials for pads 19 includes various types of elastomeric materials, foam, rubber, suitable plastics, suitable polymeric materials and/or the like.

Pads 19 may be adhesively bonded or otherwise fastened (by suitable fasteners or suitable fastening mechanisms) atop rider-support surface 15 of board 10. Pads 19 may additionally or alternatively be adhesively bonded or otherwise fastened (by suitable fasteners or suitable fastening mechanisms) to the bottoms of legs 62, 64 of rails 42. Depending on the materials from which pads 19 are fabricated, pads 19 may become fatigued with extensive use or over time. Such fatigue may reduce the forces associated with deforming (i.e. compressing) pads 19 and may reduce the restorative forces that tend to cause pads 19 to restore themselves to their original size and shape. In such embodiments, it may be desirable to replace pads 19 from time to time. In such embodiments, it may be desirable to mount pads 19 atop rider-support surface of board 10 or to legs 62, 64 using a removable adhesive and/or a removable fastening system.

In some embodiments, the restorative forces associated with the deformation of pads 19 may be such that contact is either maintained between pads 19 and legs 62, 64 of rails 42 and/or between pads 19 and board 10 or there is minimal space between pads 19 and legs 62, 64 of rails 42 and/or between pads 19 and board 10 for most of the torques associated with conventional riding. Maintaining contact between legs 62, 64 and pads 19 is not necessary. In some embodiments, it may be possible to pivot foot-retainer 18 sufficiently far in direction 90 (FIG. 5A) that toe-side legs 64 separate from toe-side pads 19C, 19D or toe-side pads 19C, 19D separate from rider-support surface 15 of board 10 and/or sufficiently far in direction 92 (FIG. 5B) that heel-side legs 62 separate from heel-side pads 19A, 19B or heel side pads 19A, 19B separate from rider-support surface 15 of board 10.

the illustrated embodiment of FIGS. 1-5, movement joints 20 of binding 12 comprise pivot couplings 20 which pivot about pivot axis 22 that is generally concentric with pivot couplings 20. This is not necessary. In some embodiments, movement joints 20 may provide different techniques for moving a foot-retainer and a rider's foot relative to a base and/or a recreational board 10.

Figure 6A:
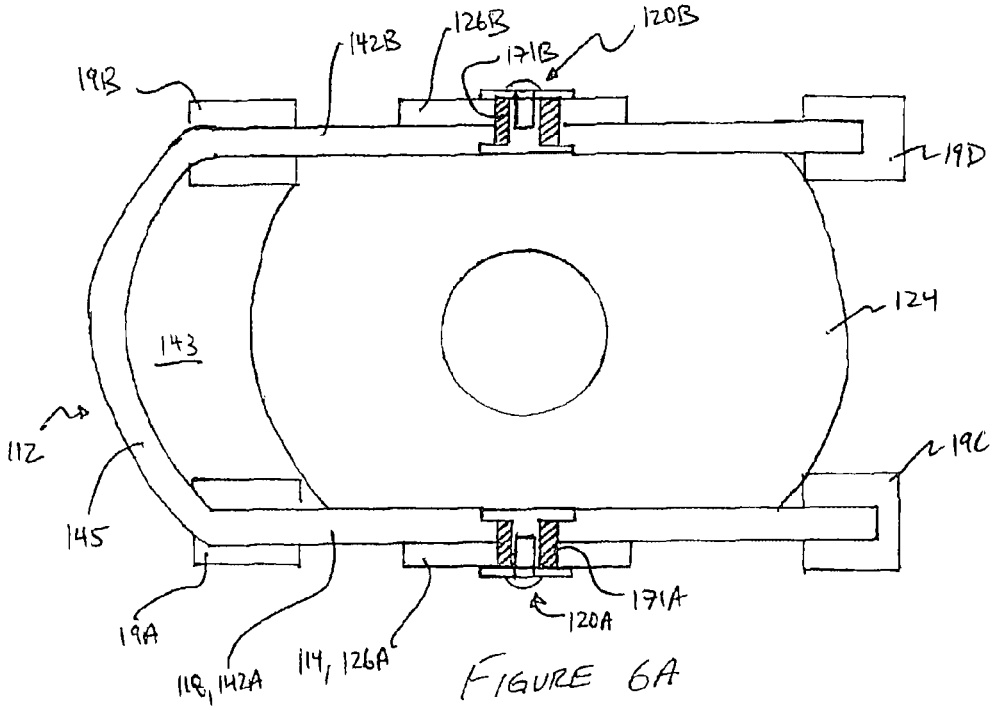
FIGS. 6A and 6B are respectively partial top cross-sectional and partial rear views of a binding system according to another embodiment of the invention with the strapping system removed for clarity.
Figure 6B:
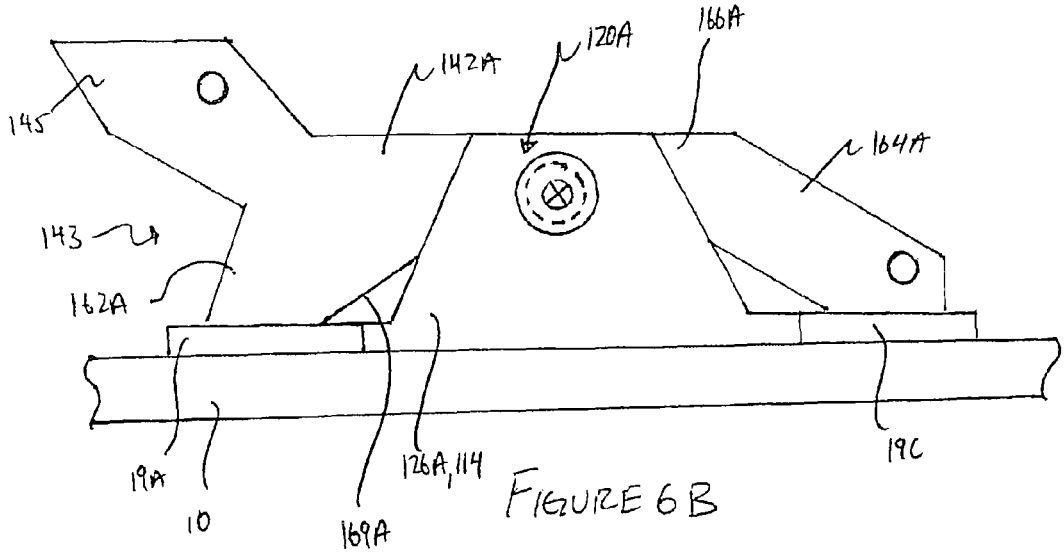

FIGS. 6A and 6B respectively depict partial top cross-sectional and partial rear views of a binding system 112 according to another embodiment. For clarity, the strapping system of binding system 112 is not shown in FIGS. 6A and 6B. In many respects, binding system 112 is similar to binding system 12 described above. More particularly, binding system 112 comprises a base 114 which is rigidly mounted to board 10 such that stand-off flanges 126A, 126B (collectively, stand-off flanges 126) extend upwardly from rider-support surface 15 of board 10 to locate movement joints 120A, 120B (collectively, movement joints 120) at locations spaced upwardly apart from rider-support surface 15 and from the lowermost part of binding 112. In the illustrated embodiment of FIGS. 6A and 6B, base 114 also comprises a base plate 124, but, in a manner similar to binding 12' of FIGS. 7A and 7B, base plate 124 is not necessary. Binding 112 also comprises a foot-retainer 118 which is coupled to base 114 via movement joints 120 so as to be moveable relative to board 10 and base 114. Foot-retainer 118 of binding 112 is similar in many respects to foot-retainer 18 of binding 12 and comprises: a heel cup 145 which defines a heel-side aperture 143, a pair of rails 142A, 142B (collectively rails 142) which extend from heel cup 145 toward the toe-side of board 10, a high back (not shown in the illustrated views) and a strapping system (not shown in the illustrated views). In the illustrated embodiment, rails 142 comprise heel-side legs 162A, 162B (collectively, heel-side legs 162) and toe-side legs 164A, 164B (collectively, toe-side legs 164) and central portions 166A, 166B (collectively, central portions 166) which together define concave lower edges 169A, 169B (collectively, concave lower edges 169). These features of rails 142 of binding 112 may be similar to corresponding features of rails 42 of binding 12. Binding system 112 may also comprise pads 19 between heel-side legs 62, toe-side legs 64 and rider-support surface 15 of board 10.

Binding 112 differs primarily from bindings 12 described above in that movement joints 120 of binding 112 are not pivot couplings and permit more generalized movement of foot-retainer 118 and the rider's foot relative to base 114 and board 10. Movement joints 120 comprise deformable (e.g. compressible) bushings 171A, 171B (collectively, bushings 171) which may be deformed to facilitate movement between foot-retainer 118 and base 114. Bushings 171 may be elastically deformable such that they tend to restore their original shape after being compressed by external forces.

Figure 6C:
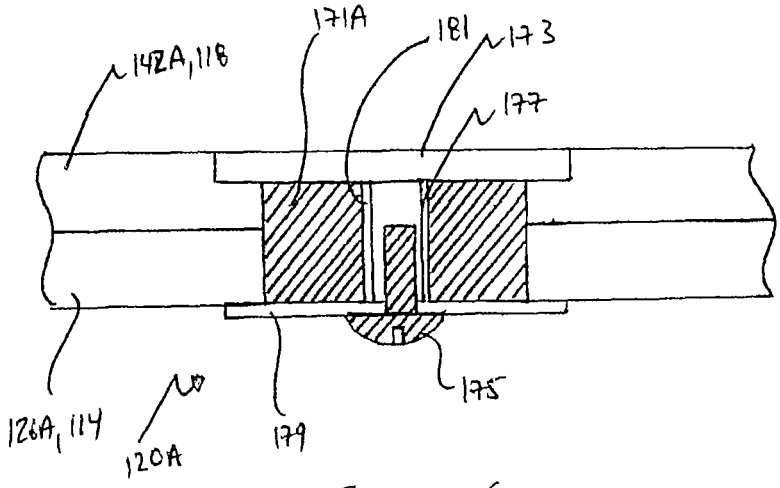
FIGS. 6C and 6D are respectively magnified cross-sectional and magnified exploded cross-sectional views of a movement joint between a rail and a stand-off flange of the FIG. 6A, 6B binding system.
Figure 6D:
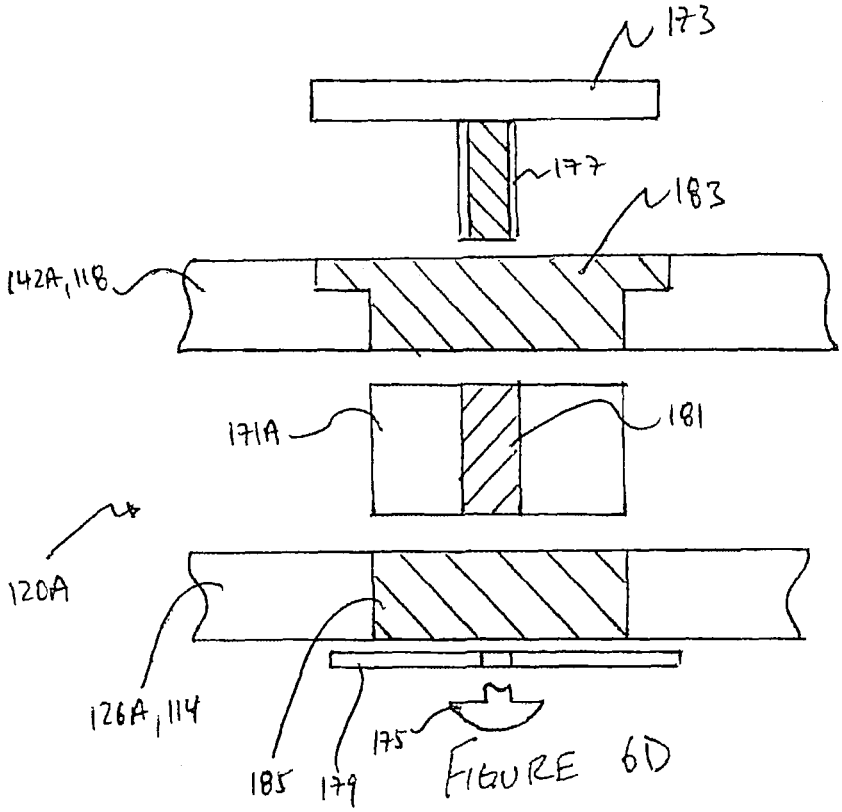

FIGS. 6C and 6D are respectively magnified cross-sectional and magnified exploded cross-sectional views of movement joint 120A between rail 142A of foot-retainer 118 and stand-off flange 126A of base 114 of binding 112. As can be seen from FIGS. 6C and 6D, movement joint 120A comprises a bushing 171A which has a portion located in an aperture 183 of rail 142 and a portion located in an aperture 185 of stand-off flange 126A. Bushing 171A is penetrated by a bore 181. Movement joint 120A also comprises a pair of fastener components 173, 175 which are coupleable to one another from opposing sides of rail 142A and stand-off flange 126A to provide a central shaft 177 which extends through bore 181 of bushing 171A. In one particular embodiment, fastener component 173 comprises a female threaded bore 177 and fastener component 175 comprises a male threaded shaft that is threadably extendable into bore 177. In some embodiments, one or more washers 179 may be provided between fastener components 173, 175. In other embodiments, different fastener components can be used in addition to or as an alternative to fastener components 173, 175.

In operation, when a user exerts force on foot-retainer 118, portions of bushings 171 of movement joints 120 may be compressed to facilitate the movement of foot-retainer 118 relative to base 114 and board 10. In addition, movement joints 120 may also permit pivotal movement—for example, foot-retainer 118 may pivot about the outer surface of bushings 171 and/or foot-retainer 118 and bushings 171 may pivot about shaft 177. Such movement of foot-retainer 118 relative to base 114 and board 10 may also comprise compression of one or more of pads 119.

Binding 112 also differs from binding 12 of FIGS. 1-5 in that rails 142 are located on the insides of (i.e. closer to the rider's foot than) stand-off flanges 126, whereas rails 42 of binding 12 are located on the outsides of (i.e. further from the rider's foot than) stand-off flanges 26. However, this relative orientation may be changed for either of bindings 12, 112. More particularly, for binding 112, rails 142 may be located on the outsides of stand-off flanges 126.

Figure 6E:
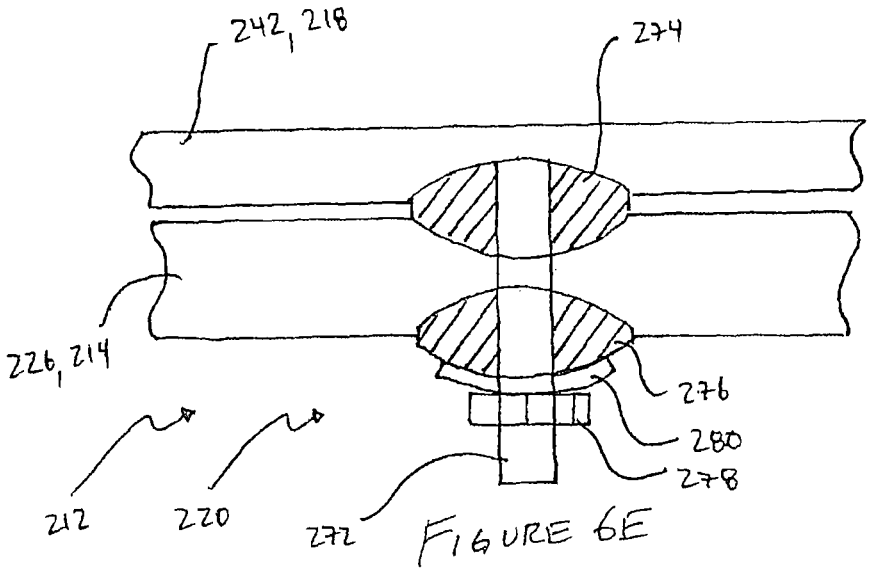
FIGS. 6E and 6F are respectively magnified cross-sectional and magnified exploded cross-sectional views of another example movement joint suitable for use between a rail and a stand-off flange of a binding system according to another example embodiment.
Figure 6F:
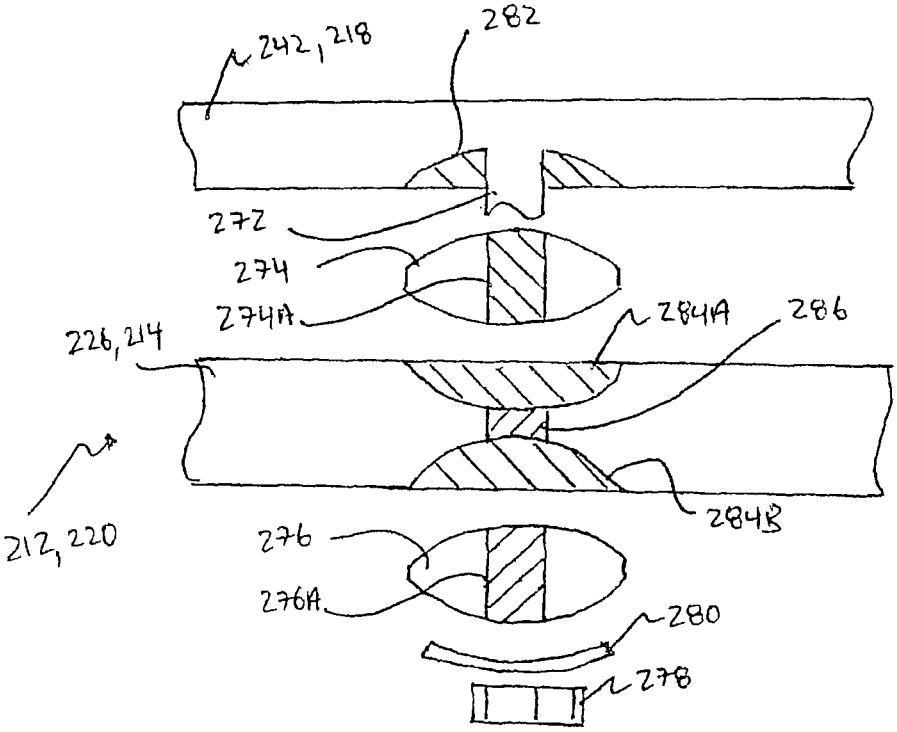

In other embodiments, the movement joints between foot-retainers and bases may be provided by a variety of other configurations which involved the deformation (e.g. compression) of elastomeric bushings. FIGS. 6E and 6F are respectively magnified cross-sectional and magnified exploded cross-sectional views of another example movement joint 220 suitable for use between a rail 242 and a stand-off flange 226 of a binding system 212 according to another example embodiment. Movement joint 220 may be used as an alternative movement joint for any of the binding systems described herein. Movement joint 220 comprises a king pin shaft 272 which may be threaded. In the illustrated embodiment, king pin shaft 272 is integrally formed with and extends outwardly from rail 242. In other embodiments, king pin shaft 272 may be integrally formed with stand-off 226 or may be coupleable to either rail 242 or stand-off 226. Movement joint 220 also comprises a pair of bushings 274, 276 having corresponding bores 274A, 276A such that king pin shaft 272 extends through bores 274A, 276A. King pin shaft 272 extends from rail 242 through bore 274A of first bushing 274 which is located between rail 242 and stand-off flange 226. Rail 242 and stand-off flange 226 may comprise concavities 282, 284A which accommodate portions of first bushing 274. King pin shaft 272 then extends through a bore 286 of stand-off flange 226. King pin shaft 272 then extends through bore 276A of second bushing 276 which is located on an outside of stand-off flange 226. Stand-off flange 226 may comprise a concavity 284B for accommodating a portion of second bushing 276. King pin shaft 272 of the illustrated embodiment is then capped by suitable fastener components which, in the illustrated embodiment, comprise a washer 280 and a nut 278.

In operation, when a user exerts force on foot-retainer 218, portions of bushings 274, 276 of movement joints 220 may be compressed to facilitate the movement of foot-retainer 218 relative to base 214 and board 10. Such movement of foot-retainer 218 relative to base 214 and board 10 may also comprise compression of one or more of pads similar to pads 19 described above. The relative amount of force required to compress bushings 274, 276 may be controlled be the tightness of fastener component 278 on king pin shaft 272. For example, when fastener component 278 is relatively tight on king pin shaft 272, it actually pre-compresses bushings 274, 276, making it relatively hard for a rider to further compress bushings 274, 276 to move foot-retainer 218 relative to base 214. In contrast, when fastener component 278 is relatively loose on king pin shaft 272, it is relatively easy to compress bushings 274, 276 and to thereby move foot-retainer 218 relative to base 214.

In the illustrated embodiment of movement joint 220, king pin shaft 272 is integrally formed with or rigidly connected to rail 242 and extends through stand-off flange 226. In other embodiments, the king pin shaft could be integrally formed with or rigidly connected to stand-off flange 226 and could extend through rail 242.

Figure 6G:
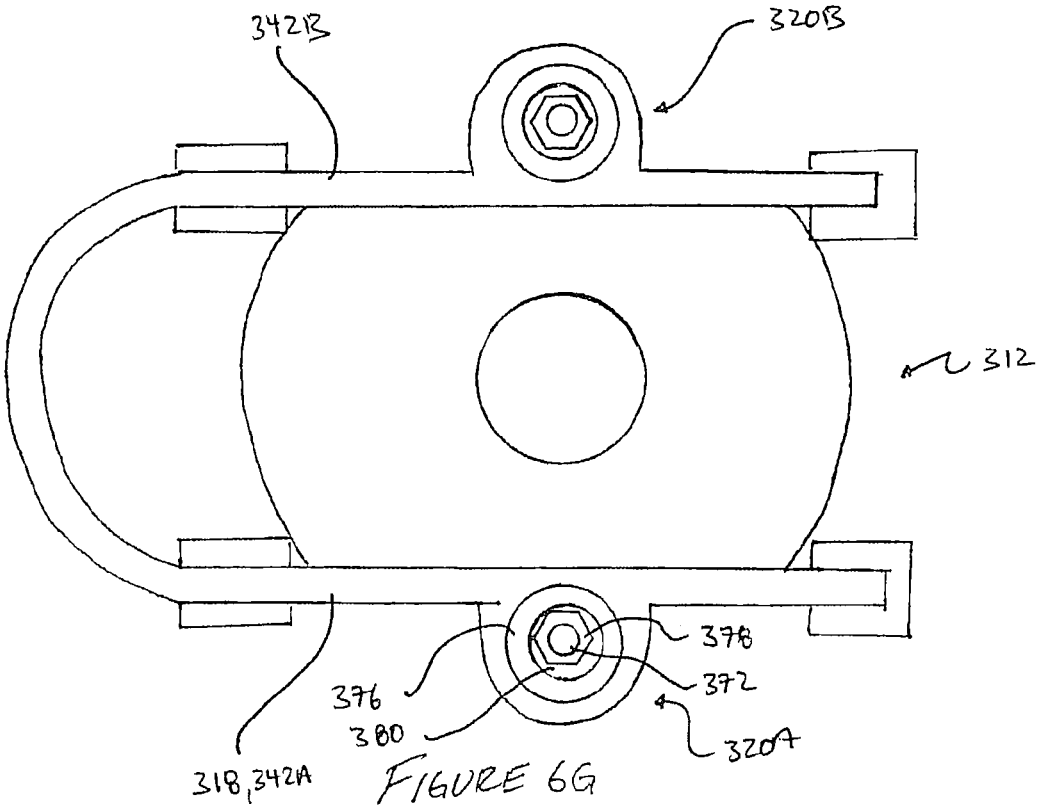
FIGS. 6G and 6H are respectively partial top and partial rear views of a binding system according to another embodiment of the invention with the strapping system removed for clarity.
Figure 6H:
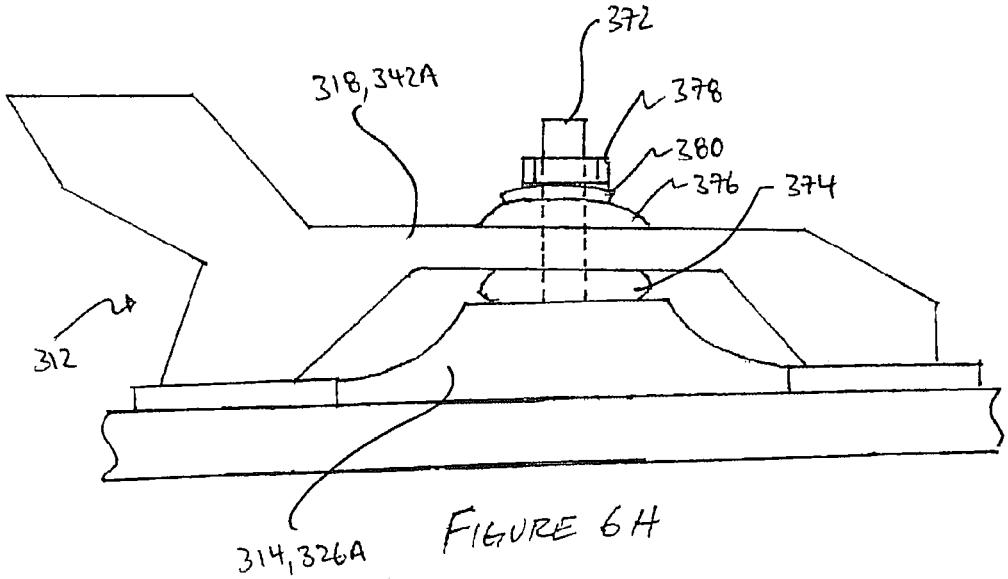

FIGS. 6G and 6H are respectively partial top and partial rear views of a binding system 312 according to another embodiment of the invention comprising another type of movement joint 320A, 320B (collectively, movement joints 320) which facilitate relative movement between foot-retainer 318 and base 314 and board 10. For clarity, the strapping system of binding 312 is not shown in FIGS. 6G, 6H. Movement joints 320 of the illustrated embodiment of FIGS. 6G and 6H facilitate relative movement between rails 242A, 242B (collectively, rails 242) and stand-off flanges 326A, 326B (collectively, stand-off flanges 326). Movement joints 320 are similar to movement joints 220 (FIGS. 6E, 6F), except that king pin shafts 372 of movement joints 320 are oriented generally vertically. More particularly, movement joint 320 comprise king pin shafts 372 which extend upwardly from stand-off flanges 326 through first deformable bushings 374, through rails 342 and through second deformable bushings 376. Fastener components 378 and optional washers 380 threadably tighten onto king pin shafts 372. Bushings 374, 376 may be elastically deformable.

Operation of movement joints 320 may be similar to operation of movement joints 220. When a user exerts force on foot-retainer 318, portions of bushings 374, 376 may be compressed to facilitate the movement of foot-retainer 318 relative to base 314 and board 10. Such movement of foot-retainer 318 relative to base 314 and board 10 may also comprise compression of one or more of pads similar to pads 19 described above. Like movement joints 220 described above, the relative amount of force required to compress bushings 374, 376 may be controlled be the tightness of fastener component 378 on king pin shaft 372.

In the illustrated embodiment of movement joint 320, king pin shaft 372 is integrally formed with or rigidly connected to stand-off flange 326 and extends upwardly through rail 342. In other embodiments, the king pin shaft could be integrally formed with or rigidly connected to rail 342 and could extend through stand-off flange 326.

Figure 8:
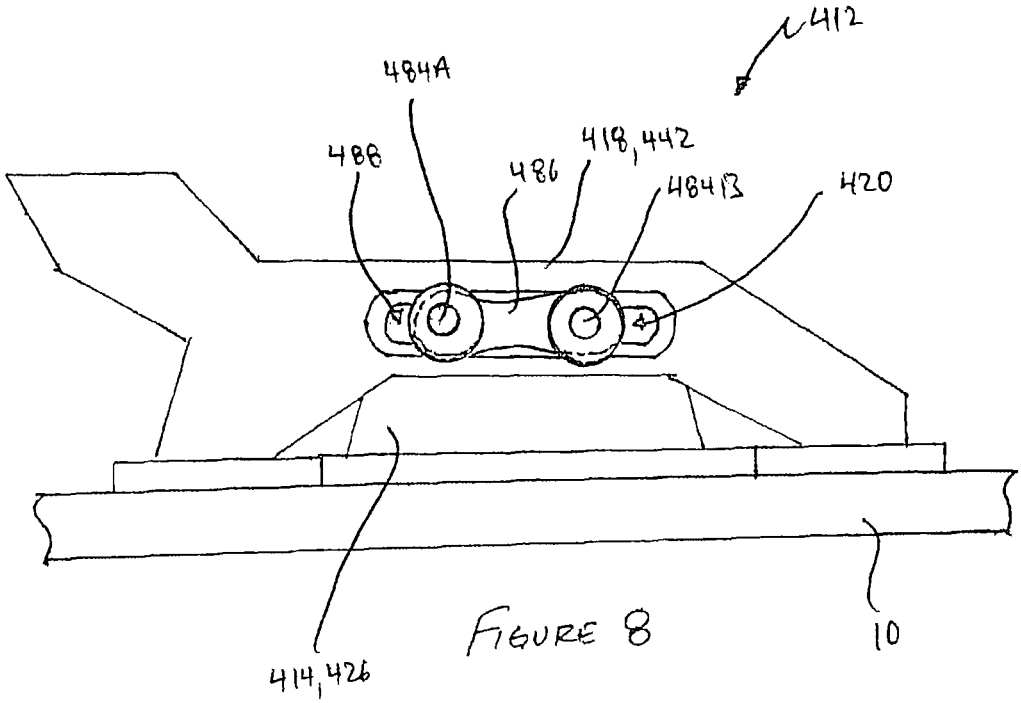
FIG. 8 is a partial rear of a binding system according to another embodiment of the invention with the strapping system removed for clarity.

FIG. 8 is a partial rear of a binding system 412 according to another embodiment of the invention with the strapping system removed for clarity. Binding system 412 comprises yet another type of movement joint 420 which facilitates the relative movement between foot-retainer 418 (e.g. rails 442) and base 414 (e.g. stand-off flanges 426). Movement joint 420 comprises a pair of fasteners 484A, 484B which extend through apertures 488 in rails 442, deformable bushing 486 and comparable apertures in stand-off flanges 426. Deformable bushing 486 may be elastically deformable and may tend to restore itself when compressed. The plurality of fasteners 484 may add strength to movement joint 420. In operation, movement joint 420 may be similar to movement joint 120 of FIGS. 6A-6D. Forces applied by a rider to foot-retainer 418 cause compression of bushing 486 and corresponding movement of foot-retainer 418 (e.g. rails 442) relative to base 414 (e.g. stand-off flanges 426) and board 10.

As will be apparent to those skilled in the art in the light of the foregoing disclosure, many alterations and modifications are possible in the practice of this invention without departing from the spirit or scope thereof. For example:

The binding systems described herein incorporate a number of features which are similar to those of particular prior art snowboard bindings. There are a wide variety of snowboard bindings. Suitable modifications to the bindings described herein may be made to accommodate components of other types of snowboard binding systems.

While particularly suited for snowboard bindings, the binding systems described herein are not limited to the particular application where the recreational board is a snowboard and the bindings are snowboard bindings. Those skilled in the art will appreciate that the innovative binding systems of the present invention may be used in a variety of other sports or activities where a rider's feet are retained by bindings to a rider-support surface of a recreational board. By way of non-limiting example, the binding systems of the present invention may be used to provide bindings for surfboards, windsurf boards, wakeboards, sky surfing boards, kitesurfing boards or the like. Suitable modifications may be made to the embodiments described herein to provide binding systems for other recreational boards.

In the illustrated embodiment of FIGS. 1-5, binding base 14 comprises stand-off flanges 26 which extend upwardly from base plate 24 to locate pivot couplings 20 in locations spaced upwardly apart from rider-support surface 15. This is not necessary. In some embodiments, the thickness of base plate 24, the desired range of pivotal motion about pivot axis 22 and/or the desired spacing of pivot axis 22 away from rider-support surface 15 of board 10 may be such that it is possible to accommodate pivot couplings 20 in base plate 24. Such embodiments may not include stand-off flanges 26.

In the illustrated embodiment of FIGS. 1-5, stand-off flanges 26 are generally planar and extend upwardly from base plate 24 of base 14. This is not necessary. In some embodiments, it may be desirable to provide stand-off flanges 26 with contoured shapes which may help to accommodate the rider's foot.

In the illustrated embodiment of FIGS. 1-5, stand-off flanges 26 are located closer to the rider's foot than (i.e. inside of) corresponding rails 42. This is not necessary. In some embodiments, base 14 may be designed such that one or both of stand-off flanges 26 are located further from the rider's foot than (i.e. outside of) corresponding rails 42. In still other embodiments, stand-off flanges 26 may be provided with a U-shape or some other shape that provides an upwardly opening groove and rails 42 may fit into the upwardly opening groove, such that stand-off flanges 26 are effectively inside and outside of rails 42.

In some embodiments, heel retainer 40 of foot-retainer 18 is not required. For example, in some embodiments, the combination of strapping system 47 and rails 42 is sufficient to permit the rider to operate binding 12 and board 10 as described above without using heel retainer 40. Similarly, in some embodiments, high back portion 41 of heel retainer 40 is not required. For example, in some embodiments, the combination of strapping system 47, rails 42 and a low-rise heel retainer 40 is sufficient to permit the rider to operate binding 12 and board 10 as described above.

Binding 12 in the embodiment of FIGS. 1-5 makes use of strapping system 47 to retain the rider's foot between rails 42. In other embodiments (e.g. where a rider wears relatively stiff footwear, such as a hard-shell boot or the like), strapping system 47 may be modified and/or replaced to provide a so-called "step-in" binding system. In such embodiments, a step-in binding system may be rigidly coupled to (or integrally formed with) foot-retainer 18 (e.g. rails 42) and interacts with the user's footwear to retain the rider's foot in relation to foot-retainer 18. For example, such step-in binding systems may interact with heel welts and/or toe welts of hard-shell boots to retain the rider's foot relative to foot-retainer 18.

In the illustrated embodiment of FIGS. 1-5, rails 42A and 42B are connected to one another at heel retainer 40 (i.e. on the heel side of heel side legs 62), but are not connected to one another between heel side legs 62 and toe side legs 64. In some embodiments, rails 42A, 42B may be connected to one another by a heel-side brace which extends between rails 42A, 42B in a vicinity of heel-side legs 62. In such embodiments, heel-side pads 19A, 19B may be replaced by a single heel-side pad which extends under the heel-side brace. Such a heel-side brace may provide binding 12 with additional torsional rigidity. In some embodiments, rails 42A, 42B may be connected to one another by a toe-side brace which extends between rails 42A, 42B in a vicinity of toe-side legs 64. In such embodiments, toe-side pads 19C, 19D may be replaced by a single toe-side pad which extends under the toe-side brace. Again, such a toe-side brace may provide binding 12 with additional torsional rigidity.

In some embodiments, pivot couplings 20 between rails 42 and stand-off flanges 26 may be provided with one or more deformable bushings which may serve to dampen or otherwise cushion the pivotal motion of foot-retainer 18 relative to base 14 and board 10. By way of non-limiting example, in some embodiments, apertures 38 could be transversely elongated (in a manner similar to apertures 44) and a bushing could be provided to extend between apertures 38, 44 at the transverse extremes of apertures 38, 44. In such embodiments, pivotal motion toward heel edge 24A would involve compression of the heel-side bushing and pivotal motion of foot-retainer 18 toward toe edge 24B would involve compression of the toe-side bushing. In other embodiments, pivot joints 20 may be provided with other suitable dampening mechanisms. The deformable bushings of some other embodiments may serve to dampen or otherwise cushion the non-pivotal motion of the foot-retainer relative to the base and/or relative to the board.

Referring to FIG. 1, it may be seen that in the illustrated embodiment of FIGS. 1-5, pivot axis 22 is slightly skewed relative to longitudinal axis 21 of board 10. In general, the angle of this skew between pivot axis 22 and longitudinal axis 21 will depend on the orientation of binding 12 relative to board 10 which may be rider-adjustable as discussed above. For most riders, the angle of this skew between pivot axis 22 and longitudinal axis 21 is in a range of 0° to 45°. In some embodiments, this angle is in a range of 0° to 28°. In general, the rearward binding (not shown) may be oriented at a different angle relative to board 10, such that skew angle between the pivot axis of the rearward binding and longitudinal axis 21 is different than the skew angle for forward binding 12. For most riders, the angle of the skew between the pivot axis of the rearward binding 12 and longitudinal axis 21 is in a range of −45° to 45°. In some embodiments, this angle is in a range of −28° to 28°

In some embodiments, it may be desirable to have pivot axis 22 align more closely to longitudinal axis 21. This alignment may be achieved by orienting pivot couplings 20 in alignment with (or in relatively closer alignment with) longitudinal axis 21 in any suitable manner. It may be desirable to allow a rider to achieve this angular orientation of pivot axis 22 without changing (or without substantially changing) the stance angle of the rider's feet have with board 10. The stance angle may refer to the orientation of the bindings relative to board 10 about a vertically extending axis. Such angular orientations of pivot axis 22 may be achieved using a wide variety of techniques. By way of non-limiting example, one or more wedge-shaped (and optionally elastically deformable) spacers may be used on either (or both) sides of apertures 38, 44 (or between apertures 38, 44) to provide the desired angular offset, pivot couplings 20 may be provided with suitably skewed flanges 74, 76 to provide the desired angular offset, specialized pivot couplings 20 which incorporate an angular skew may be used to provide the desired offset, rails 42 may be provided with suitably angled (e.g. wedge shaped) cross-sections to provide the desired angular offset or the like.

In the illustrated embodiment of FIGS. 1-5, rails 42 are symmetrical and have the same length. These features are not necessary. In some embodiments, rails 42 may be asymmetrical. Rails 42 may be shaped (e.g. contoured) to fit more closely to the rider's feet. In some embodiments, rails 42 may have different lengths. The length of each rail 42 may depend on the stance angle of rider (i.e. the angular orientation of bindings 12 with respect to longitudinal axis 21. In one particular embodiment, the length of each rail 42 is selected such that legs 62 and/or legs 64 are aligned along lines that are generally parallel to longitudinal axis 21.

What is claimed is:

1. A binding system for retaining a rider's foot atop a recreational board, the binding system comprising:

a base rigidly mountable to the recreational board; and a foot-retainer for retaining the rider's foot in generally fixed relation thereto, the foot-retainer moveably coupled to the base at a pair of movement joints for motion of the foot-retainer and the rider's foot relative to the base and the recreational board;

the base comprising: a base plate shaped to abut against a rider-support surface of the recreational board on a lower surface thereof, shaped to receive a bottom of the rider's foot on an opposed upper surface thereof and shaped to extend longitudinally between a front stand-off flange and a rear stand-off flange, the front stand-off flange shaped to locate a corresponding front movement joint at a front joint location spaced upwardly apart from the foot-receiving upper surface of the base plate and the rear stand-off flange shaped to locate a corresponding rear movement joint at a rear joint location spaced upwardly apart from the foot-receiving upper surface of the base plate;

wherein each of the pair of movement joints comprises one or more deformable bushings and wherein portions of the one or more bushings deform to facilitate motion of the foot-retainer relative to the base.

2. A binding system according to claim 1 wherein the front and rear movement joints respectively comprise front and rear pivot couplings and wherein the foot-retainer is pivotally coupled to the base for pivotal motion of the foot-retainer and the rider's foot relative to the base and the recreational boards.

3. A binding system according to claim 2 wherein the foot-retainer comprises a front rail and a rear rail longitudinally spaced apart from one another for receiving the rider's foot therebetween.

4. A binding system according to claim 1 wherein the pair of movement joints each comprise a shaft that extends between the foot-retainer and the base and wherein motion of the foot-retainer and the rider's foot relative to the base and the recreational board is associated with corresponding movement of the shaft.

5. A binding system according to claim 4 wherein, for each of the pair of movement joints, the shaft extends through a bore of each of the one or more deformable bushings.

6. A binding system according to claim 4 wherein the shaft extends in a plane generally parallel to a rider-support surface of the recreational board in an absence of forces applied by the rider.

7. A binding system according to claim 4 wherein the shaft extends generally vertically between the foot-retainer and the base in an absence of forces applied by the rider.

8. A binding system according to claim 1 wherein, for each of the pair of movement joints, at least one of the one or more bushings extends between the foot-retainer and the base.

9. A binding system according to claim 1 wherein, for each of the pair of movement joints, at least one of the one or more bushings is located on a side of the base opposite that of the foot-retainer.

10. A binding system according to claim 1 wherein, for each of the pair of movement joints, at least one of the one or more bushings is located on a side of the foot-retainer opposite that of the base.

11. A binding system according to claim 1 wherein each of the pair of movement joints comprises a plurality of shafts that extend between the foot-retainer and the base and wherein motion of the foot-retainer and the rider's foot relative to the base and the recreational board is associated with corresponding movement of the plurality of shafts.

12. A binding system according to claim 1 wherein the foot-retainer comprises a front rail and a rear rail longitudinally spaced apart from one another for receiving the rider's foot therebetween.

13. A binding system according to claim 12 wherein the front stand-off flange is moveably coupled to the front rail by the front movement joint, the front rail and the front stand-off flange shaped to locate the front movement joint at the front joint location spaced upwardly apart from the foot-receiving upper surface of the base plate; and wherein the rear stand-off flange is moveably coupled to the rear rail by the rear movement joint, the rear rail and the rear stand-off flange shaped to locate the rear movement joint at the rear joint location spaced upwardly apart from the foot-receiving upper surface of the base plate.

14. A binding system according to claim 13 wherein the front and rear rails are apertured with apertures elongated in a transverse direction for adjustability of transverse locations of the front and rear rails relative to the front and rear stand-off flanges and the front and rear movement joints.

15. A binding system according to claim 14 wherein the apertures of the front and rear rails comprise transversely spaced apart concavities between vertically extending projections for supporting the front and rear movement joints within the transversely spaced apart concavities.

16. A binding system according to claim 12 wherein the front and rear rails each comprise a concave lower edge.

17. A binding system according to claim 12 wherein each of the front and rear rails comprises: a central portion spaced upwardly apart from a lowermost portion of the binding; a toe-side leg which extends downwardly from the central portion on a toe side thereof; and a heel-side leg which extends downwardly from the central portion on a heel side thereof.

18. A binding system according to claim 17 comprising:

one or more toe-side deformable pads located below lowermost portions of the toe-side legs of the front and rear rails; and one or more heel-side deformable pads located below lowermost portion of the heel-side legs of the front and rear rails;

wherein motion of the foot-retainer relative to the base and the recreational board causes compression of at least one of: the one or more toe-side deformable pads and the one or more heel-side deformable pads.

19. A binding system for retaining a rider's foot atop a recreational board, the binding system comprising:

a base rigidly mountable to the recreational board; and a foot-retainer for retaining the rider's foot in generally fixed relation thereto, the foot-retainer moveably coupled to the base at a pair of movement joints for motion of the foot-retainer and the rider's foot relative to the base and the recreational board;

the base comprising: a base plate shaped to abut against a rider-support surface of the recreational board on a lower surface thereof, shaped to receive a bottom of the rider's foot on an opposed upper surface thereof and shaped to extend longitudinally between a front stand-off flange and a rear stand-off flange, the front stand-off flange shaped to locate a corresponding front movement joint at a front joint location spaced upwardly apart from the foot-receiving upper surface of the base plate and the rear stand-off flange shaped to locate a corresponding rear movement joint at a rear joint location spaced upwardly apart from the foot-receiving upper surface of the base plate;

wherein the front and rear movement joints respectively comprise front and rear pivot couplings and wherein the foot-retainer is pivotally coupled to the base for pivotal motion of the foot-retainer and the rider's foot relative to the base and the recreational board;

wherein the foot-retainer comprises a front rail and a rear rail longitudinally spaced apart from one another for receiving the rider's foot therebetween; and wherein the foot-retainer comprises:

a high-back located on the heel-side of the binding and extending between and upwardly from the front and rear rails, the high-back comprising a concave surface shaped to accommodate a heel of the rider's foot; and a strapping system extending longitudinally between one or more of: the front and rear rails and front and rear portions of the high back, the strapping system adjustable to a first configuration where the rider's foot is retained under the strapping system and against the concave surface of the high back so as to be generally fixed in relation to the foot-retainer and to a second configuration wherein the rider's foot is insertable into and removable from the foot-retainer.

20. A binding system according to claim 19 wherein the base comprises a front mounting flange that projects forwardly from the front stand-off flange and a rear mounting flange that projects rearwardly from the rear stand-off flange.

21. A binding system according to claim 20 wherein the front and rear mounting flanges are shaped to abut against a rider-support surface of the recreational board and are apertured for projection of fasteners therethrough to mount the binding to the recreational board.

22. A binding system according to claim 19 wherein the base plate comprises:

a generally circularly shaped cut-out having an annular region of upwardly facing, radially extending ridges around a perimeter thereof; and a generally circularly shaped mounting disc having an annular region of downwardly facing, radially extending ridges inside a perimeter thereof, the downwardly facing ridges of the mounting disc shaped to engage the upwardly facing ridges in the annular region around the perimeter of the cut-out;

wherein the mounting disc is apertured for projection of one or more fasteners therethrough to mount the binding to the recreational board.

23. A binding system according to claim 19 wherein the front stand-off flange is pivotally mounted to the front rail by the front pivot coupling, the front rail and the front stand-off flange shaped to locate the front pivot coupling at a front pivot location spaced upwardly apart from the foot-receiving upper surface of the base plate; and wherein the rear stand-off flange is pivotally mounted to the rear rail by the rear pivot coupling, the rear rail and the rear stand-off flange shaped to locate the rear pivot coupling at a rear pivot location spaced upwardly apart from foot-receiving upper surface of the base plate.

24. A binding system according to claim 23 wherein the front and rear rails are apertured with apertures elongated in a transverse direction for adjustability of transverse locations of the front and rear rails relative to the front and rear stand-off flanges and the front and rear pivot couplings.

25. A binding system according to claim 24 wherein the apertures of the front and rear rails comprise transversely spaced apart concavities between vertically extending projections for supporting the front and rear pivot couplings within the transversely spaced apart concavities.

26. A binding system according to claim 23 wherein:

the front pivot coupling comprises a front pivot pin that is generally circular in cross-section such that pivotal motion of the foot-retainer relative to the base and to the board is associated with one or more of: relative motion between the front rail and the front pivot pin; and relative motion between the front stand-off flange and the front pivot pin; and the rear pivot coupling comprises a rear pivot pin that is generally circular in cross-section such that pivotal motion of the foot-retainer relative to the base and to the board is associated with one or more of: relative motion between the rear rail and the rear pivot pin; and relative motion between the rear stand-off flange and the rear pivot pin.

27. A binding system according to claim 23 wherein the front and rear pivot couplings are located in range of 0.5 cm-10 cm from the foot-receiving upper surface of the base plate.

28. A binding system according to claim 19 wherein the front and rear rails each comprise a concave lower edge.

29. A binding system for retaining a rider's foot atop a recreational board, the binding system comprising:

a base rigidly mountable to the recreational board; and a foot-retainer for retaining the rider's foot in generally fixed relation thereto, the foot-retainer moveably coupled to the base at a pair of movement joints for motion of the foot-retainer and the rider's foot relative to the base and the recreational board;

the base comprising: a base plate shaped to abut against a rider-support surface of the recreational board on a lower surface thereof, shaped to receive a bottom of the rider's foot on an opposed upper surface thereof and shaped to extend longitudinally between a front stand-off flange and a rear stand-off flange, the front stand-off flange shaped to locate a corresponding front movement joint at a front joint location spaced upwardly apart from the foot-receiving upper surface of the base plate and the rear stand-off flange shaped to locate a corresponding rear movement joint at a rear joint location spaced upwardly apart from the foot-receiving upper surface of the base plate;

wherein the front and rear movement joints respectively comprise front and rear pivot couplings and wherein the foot-retainer is pivotally coupled to the base for pivotal motion of the foot-retainer and the rider's foot relative to the base and the recreational board;

wherein the foot-retainer comprises a front rail and a rear rail longitudinally spaced apart from one another for receiving the rider's foot therebetween; and wherein the front rail and the rear rail are rigidly connected to one another only by a heel cup which extends longitudinally between the front and rear rails on a heel side of the binding, the heel cup comprising a concave surface shaped to accommodate a portion of a heel of the rider's foot.

30. A binding system for retaining a rider's foot atop a recreational board, the binding system comprising:

a base rigidly mountable to the recreational board; and a foot-retainer for retaining the rider's foot in generally fixed relation thereto, the foot-retainer moveably coupled to the base at a pair of movement joints for motion of the foot-retainer and the rider's foot relative to the base and the recreational board;

the base comprising: a base plate shaped to abut against a rider-support surface of the recreational board on a lower surface thereof, shaped to receive a bottom of the rider's foot on an opposed upper surface thereof and shaped to extend longitudinally between a front stand-off flange and a rear stand-off flange, the front stand-off flange shaped to locate a corresponding front movement joint at a front joint location spaced upwardly apart from the foot-receiving upper surface of the base plate and the rear stand-off flange shaped to locate a corresponding rear movement joint at a rear joint location spaced upwardly apart from the foot-receiving upper surface of the base plate;

wherein the front and rear movement joints respectively comprise front and rear pivot couplings and wherein the foot-retainer is pivotally coupled to the base for pivotal motion of the foot-retainer and the rider's foot relative to the base and the recreational board;

wherein the foot-retainer comprises a front rail and a rear rail longitudinally spaced apart from one another for receiving the rider's foot therebetween; and wherein each of the front and rear rails comprises: a central portion spaced upwardly apart from a lowermost portion of the foot-retainer; a toe-side leg which extends downwardly from the central portion on a toe side thereof; and a heel-side leg which extends downwardly from the central portion on a heel side thereof.

31. A binding system according to claim 30 comprising:

one or more toe-side deformable pads located below lowermost portions of the toe-side legs of the front and rear rails; and one or more heel-side deformable pads located below lowermost portion of the heel-side legs of the front and rear rails;

wherein pivotal motion of the foot-retainer relative to the base and the recreational board in a first angular direction causes compression of the one or more toe-side deformable pads and pivotal motion of the foot-retainer relative to the base and the recreational board in an opposing angular direction causes compression of the one or more heel-side deformable pads.

32. A binding system according to claim 31 wherein the one or more toe-side deformable pads and the one or more heel-side deformable pads are elastically deformable such that when compressed, they exhibit restorative forces which tend to restore them to their non-compressed shapes.

33. A binding system according to claim 30 wherein:

the front stand-off flange is pivotally mounted to the front rail by the front pivot coupling, and the front rail and the front stand-off flange are shaped to locate the front pivot coupling at a front pivot location spaced upwardly apart from the foot-receiving upper surface of the base plate; and the rear stand-off flange is pivotally mounted to the rear rail by the rear pivot coupling, and the rear rail and the rear stand-off flange are shaped to locate the rear pivot coupling at a rear pivot location spaced upwardly apart from the foot-receiving upper surface of the base plate.

34. A binding system according to claim 33 wherein the front and rear rails are apertured with apertures elongated in a transverse direction for adjustability of transverse locations of the front and rear rails relative to the front and rear stand-off flanges and the front and rear pivot couplings.

35. A binding system according to claim 34 wherein the apertures of the front and rear rails comprise transversely spaced apart concavities between vertically extending projections for supporting the front and rear pivot couplings within the transversely spaced apart concavities.

36. A binding system according to claim 33 wherein:

the front pivot coupling comprises a front pivot pin that is generally circular in cross-section such that pivotal motion of the foot-retainer relative to the base and to the board is associated with one or more of: relative motion between the front rail and the front pivot pin; and relative motion between the front stand-off flange and the front pivot pin; and the rear pivot coupling comprises a rear pivot pin that is generally circular in cross-section such that pivotal motion of the foot-retainer relative to the base and to the board is associated with one or more of: relative motion between the rear rail and the rear pivot pin; and relative motion between the rear stand-off flange and the rear pivot pin.

37. A binding system according to claim 33 wherein the front and rear pivot couplings are located in range of 0.5 cm-10 cm from the foot-receiving upper surface of the base plate.

38. A binding system according to claim 30 wherein the front and rear rails each comprise a concave lower edge.

39. A binding system for retaining a rider's foot atop a recreational board, the binding system comprising:

a base rigidly mountable to the recreational board; and a foot-retainer for retaining the rider's foot in generally fixed relation thereto, the foot-retainer moveably coupled to the base at a pair of movement joints for motion of the foot-retainer and the rider's foot relative to the base and the recreational board;

the base comprising: a base plate shaped to abut against a rider-support surface of the recreational board on a lower surface thereof, shaped to receive a bottom of the rider's foot on an opposed upper surface thereof and shaped to extend longitudinally between a front stand-off flange and a rear stand-off flange, the front stand-off flange shaped to locate a corresponding front movement joint at a front joint location spaced upwardly apart from the foot-receiving upper surface of the base plate and the rear stand-off flange shaped to locate a corresponding rear movement joint at a rear joint location spaced upwardly apart from the foot-receiving upper surface of the base plate;

wherein the front and rear movement joints respectively comprise front and rear pivot couplings and wherein the foot-retainer is pivotally coupled to the base for pivotal motion of the foot-retainer and the rider's foot relative to the base and the recreational board;

wherein the foot-retainer comprises a front rail and a rear rail longitudinally spaced apart from one another for receiving the rider's foot therebetween;

wherein the front stand-off flange is pivotally mounted to the front rail by the front pivot coupling, the front rail and the front stand-off flange shaped to locate the front pivot coupling at a front pivot location spaced upwardly apart from the foot-receiving upper surface of the base plate; and wherein the rear stand-off flange is pivotally mounted to the rear rail by the rear pivot coupling, the rear rail and the rear stand-off flange shaped to locate the rear pivot coupling at a rear pivot location spaced upwardly apart from the foot-receiving upper surface of the base plate; and wherein the front and rear rails each comprise a concave lower edge and wherein the binding system comprises one or more deformable pads located between one or more lowermost portions of the front and rear rails and the recreational board.

40. A binding system according to claim 39 wherein the front and rear rails are apertured with apertures elongated in a transverse direction for adjustability of transverse locations of the front and rear rails relative to the front and rear stand-off flanges and the front and rear pivot couplings.

41. A binding system according to claim 40 wherein the apertures of the front and rear rails comprise transversely spaced apart concavities between vertically extending projections for supporting the front and rear pivot couplings within the transversely spaced apart concavities.

42. A binding system according to claim 39 wherein:

the front pivot coupling comprises a front pivot pin that is generally circular in cross-section such that pivotal motion of the foot-retainer relative to the base and to the board is associated with one or more of: relative motion between the front rail and the front pivot pin; and relative motion between the front stand-off flange and the front pivot pin; and the rear pivot coupling comprises a rear pivot pin that is generally circular in cross-section such that pivotal motion of the foot-retainer relative to the base and to the board is associated with one or more of: relative motion between the rear rail and the rear pivot pin; and relative motion between the rear stand-off flange and the rear pivot pin.

43. A binding system according to claim 39 wherein the front and rear pivot couplings are located in range of 0.5 cm-10 cm from the foot-receiving upper surface of the base plate.

44. A recreational board comprising:

a pair of bindings mounted atop a rider-support surface of the board, each binding comprising:

a base rigidly mounted atop the rider-support surface of the recreational board; and a foot-retainer for retaining a rider's foot in generally fixed relation thereto, the foot-retainer moveably coupled to the base at a pair of movement joints for motion of the foot-retainer and the rider's foot relative to the base and the recreational board;

the base comprising: a base plate shaped to abut against the rider support surface of the board on a lower surface thereof, shaped to receive a bottom of the rider's foot on an opposed upper surface thereof and to extend longitudinally between a front standoff flange and a rear standoff flange, the front standoff flange shaped to locate a corresponding front movement joint at a front joint location spaced upwardly apart from the foot-receiving upper surface of the base plate and the rear standoff flange shaped to locate a corresponding rear movement joint at a rear joint location spaced upwardly apart from the foot-receiving upper surface of the base plate;

wherein, for each binding, the front and rear movement joints each comprise one or more deformable bushings and wherein portions of the one or more bushings deform to facilitate motion of the foot-retainer relative to the base.

45. A recreational board according to claim 44 wherein, for each binding, the front and rear movement joints comprise corresponding front and rear pivot couplings and wherein the foot-retainer is pivotally coupled to the base for pivotal motion of the foot-retainer and the rider's foot relative to the base and the recreational board.

46. A recreational board according to claim 44 wherein, for each binding, the foot-retainer comprises a front rail and a rear rail longitudinally spaced apart from one another for receiving the rider's foot therebetween.

47. A recreational board according to claim 46 wherein, for each binding, the front stand-off flange is moveably coupled to the front rail by the front movement joint, the front rail and the front stand-off flange shaped to locate the front movement joint at the front joint location; and wherein the rear stand-off flange is moveably coupled to the rear rail by the rear movement joint, the rear rail and the rear stand-off flange shaped to locate the rear movement joint at the rear joint location.

48. A kit comprising:

a longitudinally elongated recreational board; and a pair of bindings mountable atop a rider-support surface of the board, each binding comprising:

a base rigidly mountable atop the rider-support surface of the recreational board; and a foot-retainer for retaining a rider's foot in generally fixed relation thereto, the foot-retainer moveably coupleable to the base at a pair of movement joints for motion of the foot-retainer and the rider's foot relative to the base and the recreational board;

the base comprising: a base plate shaped to abut against the rider-support surface of the recreational board on a lower surface thereof, shaped to receive a bottom of the rider's foot on an upper surface thereof and shaped to extend longitudinally between a front standoff flange and a rear standoff flange, the front standoff flange shaped to locate a corresponding front movement joint at a front joint location spaced upwardly apart from the foot-receiving upper surface of the base plate and a rear standoff flange shaped to locate a corresponding rear movement joint at a rear joint location spaced upwardly apart from the foot-receiving upper surface of the base plate;

wherein, for each binding, the front and rear movement joints each comprise one or more deformable bushings and wherein portions of the one or more bushings deform to facilitate motion of the foot-retainer relative to the base.

49. A kit according to claim 48 wherein, for each binding, the front and rear movement joints comprise corresponding front and rear pivot couplings and wherein the foot-retainer is pivotally coupled to the base for pivotal motion of the foot-retainer and the rider's foot relative to the base and the recreational board.

50. A kit according to claim 48 wherein, for each binding, the foot-retainer comprises a front rail and a rear rail longitudinally spaced apart from one another for receiving the rider's foot therebetween.

51. A kit according to claim 50 wherein, for each binding, the front stand-off flange is moveably coupleable to the front rail by the front movement joint, the front rail and the front stand-off flange shaped to locate the front movement joint at the front joint location; and wherein the rear stand-off flange is moveably coupleable to the rear rail by the rear movement joint, the rear rail and the rear stand-off flange shaped to locate the rear movement joint at the rear joint location.

* * * * *